US007086481B2

(12) United States Patent
Hosie et al.

(10) Patent No.: US 7,086,481 B2
(45) Date of Patent: Aug. 8, 2006

(54) WELLBORE ISOLATION APPARATUS, AND METHOD FOR TRIPPING PIPE DURING UNDERBALANCED DRILLING

(75) Inventors: David Hosie, Sugar Land, TX (US); Mike A. Luke, Houston, TX (US)

(73) Assignee: Weatherford/Lamb, Houston, TX (US)

( * ) Notice: Subject to any disclaimer, the term of this patent is extended or adjusted under 35 U.S.C. 154(b) by 295 days.

(21) Appl. No.: 10/270,015

(22) Filed: Oct. 11, 2002

(65) Prior Publication Data

US 2004/0069496 A1 Apr. 15, 2004

(51) Int. Cl.
*E21B 23/06* (2006.01)

(52) U.S. Cl. ..... 166/387; 166/123; 166/125; 166/181; 166/182; 175/230

(58) Field of Classification Search ..... 166/123, 166/125, 181, 182, 377, 387; 175/230
See application file for complete search history.

(56) References Cited

U.S. PATENT DOCUMENTS

| | | | | |
|---|---|---|---|---|
| 3,138,214 | A * | 6/1964 | Bridwell | 175/230 |
| 3,606,924 | A * | 9/1971 | Malone | 166/187 |
| 4,083,405 | A * | 4/1978 | Shirley | 166/285 |
| 5,535,824 | A * | 7/1996 | Hudson | 166/207 |
| 5,588,491 | A * | 12/1996 | Brugman et al. | 166/383 |
| 5,636,692 | A | 6/1997 | Haugen | |
| 5,697,449 | A * | 12/1997 | Hennig et al. | 166/382 |
| 5,709,265 | A | 1/1998 | Haugen et al. | |
| 6,024,169 | A | 2/2000 | Haugen | |
| 6,039,118 | A | 3/2000 | Carter et al. | |
| 6,070,670 | A | 6/2000 | Carter et al. | |
| 6,129,152 | A | 10/2000 | Hosie et al. | |
| 6,142,226 | A | 11/2000 | Vick | |

(Continued)

FOREIGN PATENT DOCUMENTS

EP 0 819 827 A2 1/1998

(Continued)

OTHER PUBLICATIONS

U.S. Appl. No. 09/658,858, filed Sep. 11, 2000, Haugen et al.

(Continued)

*Primary Examiner*—David Bagnell
*Assistant Examiner*—Giovanna M Collins
(74) *Attorney, Agent, or Firm*—Patterson & Sheridan LLP

(57) ABSTRACT

The present invention relates to an apparatus and method for isolating a wellbore condition such as formation pressure during a wellbore operation. The invention has particular application in connection with underbalanced drilling. In one arrangement, a formation isolation apparatus is provided that serves as a selectively actuatable plug. The plug in one aspect is selectively set and released by a setting/releasing tool. The setting/releasing tool includes a system for setting the plug in the wellbore, and a system for releasing the plug from the wellbore. The setting/releasing tool is releasably connected to the plug. Thus, after the plug has been set, the setting/releasing tool may be removed from the wellbore. The plug includes a flapper valve that is restrained in its open position by the setting/releasing tool. Removal of the setting/releasing tool from the wellbore allows the flapper valve to close, thereby isolating pressures in the wellbore below the flapper valve. The plug is wireline retrievable. In another aspect, a formation isolation apparatus is provided for use during sidetrack drilling operations. The sealing element is movable from a first released position below the lateral wellbore, to a set position above the lateral wellbore.

39 Claims, 20 Drawing Sheets

U.S. PATENT DOCUMENTS

| | | | | |
|---|---|---|---|---|
| 6,167,974 | B1 | 1/2001 | Webb | |
| 6,209,663 | B1 | 4/2001 | Hosie | |
| 6,250,406 | B1 | 6/2001 | Luke | |
| 6,349,771 | B1 | 2/2002 | Luke | |
| 6,367,323 | B1 | 4/2002 | Camwell et al. | |
| 6,367,566 | B1 | 4/2002 | Hill | |
| 6,374,925 | B1 | 4/2002 | Elkins et al. | |
| 6,401,826 | B1 | 6/2002 | Patel | |
| 6,412,554 | B1 | 7/2002 | Allen et al. | |
| 6,612,383 | B1 * | 9/2003 | Desai et al. | 175/61 |
| 2002/0104653 | A1 | 8/2002 | Hosie et al. | |
| 2002/0162657 | A1 | 11/2002 | Tumlin et al. | |
| 2002/0170713 | A1 | 11/2002 | Haugen et al. | |
| 2002/0195255 | A1 * | 12/2002 | Reilly | 166/384 |

FOREIGN PATENT DOCUMENTS

| | | | |
|---|---|---|---|
| GB | 2 346 633 | A | 8/2000 |
| WO | WO 200183938 | A1 * | 11/2001 |

OTHER PUBLICATIONS

Walker, et al, "Underbalanced Completions Improve Well Safety and Productivity," World Oil, Nov. 1995, pp. 35-38, 39.

"Underbalanced Drilling Provides Early Insight Into Reservoirs," Shell E&P Technology, May 2002, pp. 36-39.

"Cutting-Edge Technologies Focus on Shell's Priorities," Shell E&P Technology, May 2002, pp. 46-48.

* cited by examiner

Fig. 9A
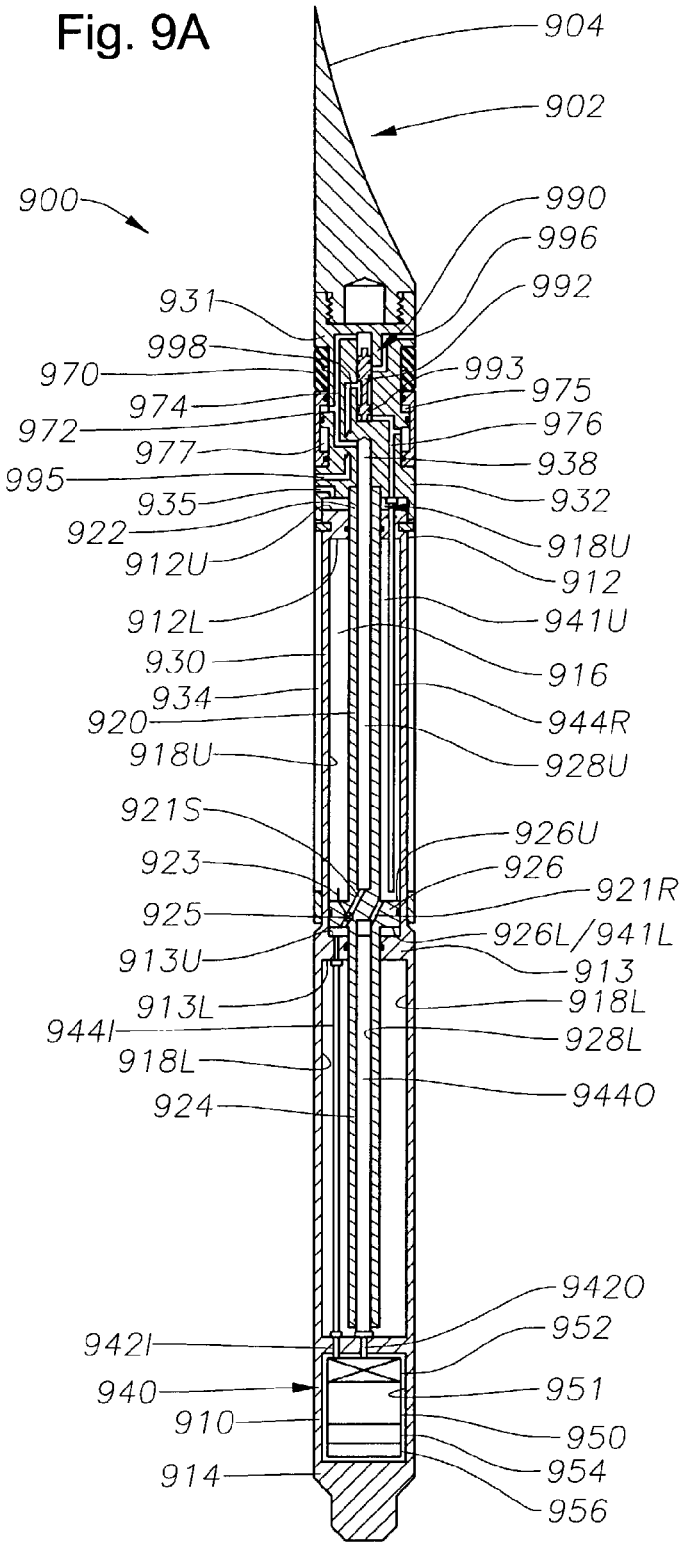
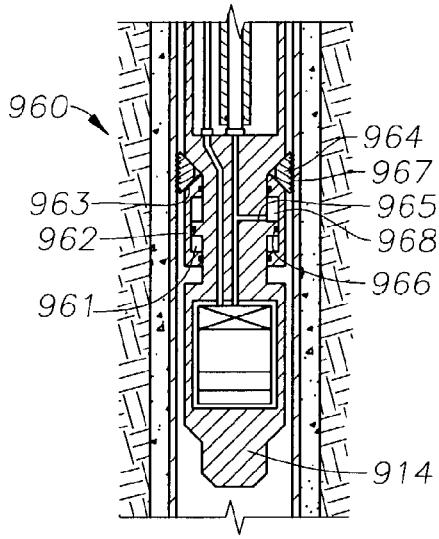
Fig. 9C
(Alternate arrangement)

WELLBORE ISOLATION APPARATUS, AND METHOD FOR TRIPPING PIPE DURING UNDERBALANCED DRILLING

BACKGROUND OF THE INVENTION

1. Field of the Invention

The present invention generally relates to the drilling of subterranean wells. More particularly, the invention relates to an apparatus for sealing a wellbore during the formation drilling process. The invention further relates to a method of underbalanced drilling, in which the wellbore is selectively sealed during drilling in order to remove dill pipe and attached tools.

2. Description of the Related Art

In the drilling of oil and gas wells, a wellbore is formed using a drill bit that is urged downwardly at a lower end of a drill string. The process of drilling typically includes the circulation of drilling fluids through the drill string. The fluids are pumped under pressure through the drill string and out ports disposed in or near the drill bit. The fluids are then circulated back to the surface on the outside of the drill string but within the formed wellbore.

The use of drilling fluid has multiple purposes. Drilling fluids serve to cool and lubricate the drill bit as it chews the rock formation en route to total depth. The fluids also permit cuttings from the formation to be lifted to the surface, thereby preserving the interface between the drill bit and the bottom of the formation. Most importantly, drilling fluids aid in controlling wellbore pressures by applying a hydrostatic force downward against the formation. This, in turn, prevents the formation from expelling formation fluids from the wellbore at a high pressure should the drill bit penetrate a high pressure zone.

Historically, drilling fluids have been weighted with tertiary material known as "mud." Drilling mud increases the downward pressure. The weighting of fluid prevents the well from "kicking" or even causing a "blow out." In an ideal situation, the mud is weighted so as to precisely counterbalance any upward force generated by formation pressures. However, because it is difficult to predict formation pressures in a timely manner, drilling operators will increase the weight of mud to an overbalanced state. This increases safety on the rig and prevents damage to the drilling equipment from a blow out.

There are disadvantages to overbalanced drilling. Primarily, the weight of drilling mud has been known to overcome the formation pressure to such an extent that the formation begins to receive the drilling mud. In this instance, drilling mud is lost to the formation and cannot be recirculated at the surface. This, in turn, requires that additional drilling mud be pumped downhole at great expense. Pumping cannot be discontinued or the well may ultimately lose all drilling fluids, causing the well to be in a dangerously underbalanced condition. Accordingly, drilling companies have recently explored ways of drilling formations in a controllably underbalanced state.

An underbalanced condition is one in which fluid pressure in a wellbore is less than fluid pressure in a formation intersected by the wellbore. There are several recognized advantages to drilling and completing a well in an underbalanced condition. First, underbalanced drilling helps prevent fluid loss from the wellbore into the formation. Those of ordinary skill in the art will appreciate that drilling mud is very expensive. Further, the loss of drilling mud into the formation can result in damage to the formation caused by infiltration of the drilling mud into the adjoining rock.

Related to this, a clean formation, i.e., one without mud infiltration, allows for a better performing well and more accurate logging measurements of the well contents. An overview of underbalanced completion practices and their advantages may be found in an article entitled "Underbalanced Completions Improve Well Safety and Productivity" by Tim Walker and Mark Hopmann (World Oil, November, 1995), which is incorporated herein by this reference.

In some cases, oil and gas can be recovered during an underbalanced drilling process. The hydrocarbons supplement the drilling fluid. In some instances, the recovery of oil/gas from the well during underbalanced drilling has been sufficient to pay for the cost of drilling the well even prior to completion of the well. For a fuller discussion of advantages of underbalanced drilling, including methods of controlling the well using an exemplary rotating blow out preventer, please refer to U.S. Pat. No. 6,129,152, entitled Rotating BOP and Method, issued Oct. 10, 2000, 1998, to Hosie et al, which is incorporated herein by reference.

Underbalanced drilling creates certain challenges to the rig operator. One such challenge relates to the process of tripping the drill string out of the wellbore. In this respect, it is necessary from time to time to replace the drill bit or change out other downhole tools. It is also necessary to periodically stop the drilling process so that a string of casing can be run into a drilled section of the well and then cemented. A problem is encountered, however, when the drill string is being pulled from an underbalanced well. In this regard, the weight of the pipe becomes less than the upward pressure being exerted by the formation. This condition, known as "pipe light," may occur when the length of the pipe becomes less than 1,500 to 1,000 feet. As the drill string becomes shorter, a danger grows that the formation may violently expel not only fluids from the formation, but the shortened drill string as well. In other words, formation pressure can actually push or accelerate the drill string out of the wellbore. In some instances, the blow out preventers may not be able to stop the upward movement of the pipe. Once the pipe string is moving upwardly, closing the rams may result in tearing the rams out rather than stopping the upward movement of the pipe. In this case, the rams will not be available to shut in the well after the pipe has been pushed from the wellbore, assuming there is someone left at the rig site to activate the rams after the drill pipe is ejected from the well. The forces are great enough so that ejected drill pipe may be found quite far from the rig. As well, sparks produced can ignite gas to produce a hot fire that can melt a drilling rig within minutes.

One method used to avoid a blow out situation is to kill the well prior to removal of the drilling string. Once the drill string is lowered back into the wellbore below the string light point, it may be possible to adjust the drilling fluids so that underbalanced drilling continues. However, formation damage may have already occurred that is substantially irreversible, and the advantages of underbalanced drilling may have been lost.

Another practice is that of providing a snubbing unit for removing the drilling string. However, the snubbing unit takes considerable time to rig up, requires considerable additional time while tripping the well, and then requires considerable additional time to rig down. Thus, the cost of tripping the drill string can be quite considerable due to the rig time costs and snubbing unit costs. Additional tripping of the well may also be necessary, and again require the snubbing unit. This procedure then, while effective and safe, increases drilling costs considerably.

Consequently, an improved apparatus and method is desired to aid in the removal of drill string from a wellbore that is drilled in an underbalanced state. Such an improved apparatus and method should enable the quick and safe removal of the drill string from the well without the need to kill the well. The apparatus and method should be useful for repeated tripping of the drill string whenever necessary without significant time and cost increases, and without need of a costly snubbing unit.

Further, a need exists for a well control tool that allows the well to be selectively shut in. In addition, a need exists for such an apparatus that may be attached to a drill string, production tubing string, or other tubular. In this manner, the apparatus may isolate a formation intersected by a wellbore in an underbalanced condition from the remainder of the wellbore while the tubular string is tripped in or out of the wellbore.

A wellbore isolation apparatus is also needed during a sidetrack drilling operation. A sidetrack drilling operation is conducted in order to create a lateral wellbore at a selected depth off of a primary wellbore. For the same reasons outlined above, it is desirable to drill lateral wellbores in an underbalanced state as well. Thus, a need exists for a well control tool that allows the primary wellbore to be selectively shut in during a sidetrack drilling operation above the depth of the lateral wellbore. In addition, a need exists for a diverter tool, such as a whipstock, that can be selectively raised above the depth of the lateral wellbore in order to seal off the lateral wellbore while the working string is tripped in and out of the primary wellbore.

SUMMARY OF THE INVENTION

An apparatus and method is provided for maintaining a wellbore condition, such as isolating formation pressures during a drilling operation. The invention has particular application in connection with underbalanced drilling. In one aspect, the apparatus is used when a string of drill pipe is being pulled from the wellbore, but before a pipe-light condition is reached. The formation isolation apparatus permits wellbore pressures below the drill bit or other downhole tool to be isolated from pressures at the surface.

In one embodiment, the formation isolation apparatus first comprises a selectively actuatable wellbore isolation member. The selectively actuatable wellbore isolation member itself has many embodiments in order to serve as a plug. In one arrangement, the selectively actuatable wellbore isolation member is made up of two separate tools—a plug tool, and a setting/releasing tool for selectively setting and releasing the plug tool. The plug tool first comprises a plug body. The plug body defines an elongated tubular member. A sealing element is disposed circumferentially around the outer surface of the plug body. The sealing element is selectively extruded outwardly to fluidly seal the wellbore around the plug body when the plug tool is set in the wellbore. The plug also comprises a flapper valve. The flapper valve is disposed internal to the plug body. The flapper valve is movable between an open position and a closed position by insertion and removal of the setting/releasing tool from the plug tool. The plug tool optionally comprises an anchoring member and a cone. The anchoring member rides outward on the cone in order to frictionally engage with a surrounding string of surface casing, or to otherwise hold the plug in place within the wellbore.

The setting/releasing tool includes a system for setting the plug tool in the wellbore, and a system for releasing the plug tool from the wellbore. In one aspect, the setting/releasing tool further comprises a solid inner mandrel, and an outer sleeve disposed around the inner mandrel. Two pressure chambers are provided between the inner mandrel and the outer sleeve. One chamber is a setting chamber, while the other chamber is a releasing chamber. Each chamber receives fluids in order to either set the plug within the wellbore, or to release the plug tool.

The setting/releasing tool is releasably connected to the plug. In one aspect, connection is via two collets. Each collet is releasably connected to a portion of the plug tool.

The plug tool is "multi-set,' meaning that the sealing element and the anchoring member, e.g., a "slip," are capable of being retracted, thereby being released from contact with the surrounding casing string when the releasing system is actuated. Thus, when fluid is injected into the releasing chamber of the setting/releasing tool, the plug is released from the surrounding casing, and may be pulled.

The apparatus for maintaining a wellbore condition also includes a wellbore operation tool. The wellbore operation tool may be a drill bit or other tool. The wellbore operation tool is coupled to the wellbore isolation member. Where the wellbore operation tool is a drill bit (or other drilling tool), the wellbore operation tool will typically be disposed below the wellbore isolation member in the wellbore. Pulling the setting/releasing tool from the plug body allows the flapper plate to close, thereby isolating formation pressures below the plug body.

The apparatus for maintaining a wellbore condition preferably also includes a tubular string. The tubular string in one use is a drill string. The drill string is releasably connected to the wellbore isolation apparatus.

In operation, the apparatus for maintaining a wellbore condition is run into the wellbore using the tubular string, such as drill pipe. The wellbore isolation apparatus is maintained in a released state while drilling operations are conducted. When the drill pipe and attached wellbore operation tools are being pulled from the wellbore, the setting system of the setting/releasing tool is actuated so as to set the plug within the formation. The setting system ultimately releases the setting/releasing tool from the plug, and the setting/releasing tool is pulled from the wellbore along with the drill pipe to which it is attached.

Next, a wireline tool is run into the well to latch into the plug. The plug is released with a straight pull, and can then be removed from the well along with the drill bit and other bottom hole assembly. The bottom hole assembly (or other wellbore operation tool) can then be changed out (or otherwise manipulated), and can be re-run on the same wireline. The plug is set using a tool that provides opposing forces between the plug body and the sealing element. The setting/releasing tool is then run back into the wellbore on drill pipe. Landing the setting/releasing tool into the plug opens the flapper valve. The releasing system of the setting/releasing tool is then actuated, releasing the plug and attached sealing element from the set position. Wellbore operations (such as underbalanced drilling operations) may then resume.

Another aspect of the invention relates to sidetrack drilling operations. An apparatus and method are provided for selectively isolating formation pressures in a lateral wellbore from pressure in the upper wellbore. In one aspect, the formation isolation apparatus is integral to the diverter tool used during a sidetrack drilling procedure. The diverter tool, such as a whipstock, is anchored in the primary wellbore at the depth where the lateral wellbore is to be drilled. The whipstock has an elongated tubular base, and a diverter portion extending above the base. The diverter portion defines a gently angled concave face that is oriented in the direction of the lateral wellbore. Those of ordinary skill in the art will understand that a milling bit is initially urged downward at the bottom end of a drill string against the concave face. The milling bit is simultaneously rotated and pushed downwardly in order to gradually mill a window through the surrounding steel casing. Thereafter, a formation drilling bit is lowered into the window at the bottom end of a drill string, and sidetrack drilling is commenced.

During the process of forming a lateral wellbore, it is oftentimes necessary to change drill bits or to otherwise remove the drill string from the wellbore. At the same time, if the lateral wellbore is in an underbalanced state, it is desirable to be able to seal off the wellbore above the depth where the lateral wellbore is being formed. Accordingly, a formation isolation apparatus is provided that in one arrangement is integral to the base of the whipstock.

The apparatus first comprises a body. The body serves as a base that is anchored into the primary wellbore below the lateral wellbore window. The apparatus next comprises a piston. The piston is urged upward from the base by an actuation system. Next, the apparatus comprises a sleeve. The sleeve generally defines a tubular body having a top end, a bottom end, and an intermediate bore. The bottom end slidingly receives the body but is not affixed to the body. The top end is connected to the whipstock's concave face, and serves as the base for the whipstock. The intermediate bore receives the piston. Thus, when the piston is actuated by the actuating system, the piston drives the sleeve and attached whipstock upward above the window of the lateral wellbore, while the body remains anchored therebelow.

This alternate formation isolation apparatus as used for sidetrack drilling operations includes a sealing element. Actuation of the actuation system causes the sealing element to be extruded outward into sealing engagement with the surrounding primary wellbore after the piston has been fully actuated. Sealing takes place above the window formed in the casing. In this way, a wellbore condition has been maintained, i.e., formation pressure in the lateral borehole is contained.

BRIEF DESCRIPTION OF THE DRAWINGS

So that the manner in which the above recited features of the present invention are attained and can be understood in detail, a more particular description of the invention, briefly summarized above, may be had by reference to the appended drawings. It is to be noted, however, that the appended drawings illustrate only typical embodiments of this invention and are therefore not to be considered limiting of its scope, for the invention may admit to other equally effective embodiments.

FIG. 9A presents yet another arrangement for a wellbore isolation apparatus that is integral to a whipstock. The apparatus is again shown in cross-section. The wellbore isolation apparatus is in its run-in position.

FIG. 9C presents a partial cross-sectional view showing the formation isolation apparatus of FIG. 9A with an optional integral anchoring system.

DETAILED DESCRIPTION OF THE PREFERRED EMBODIMENT

Figure 1:
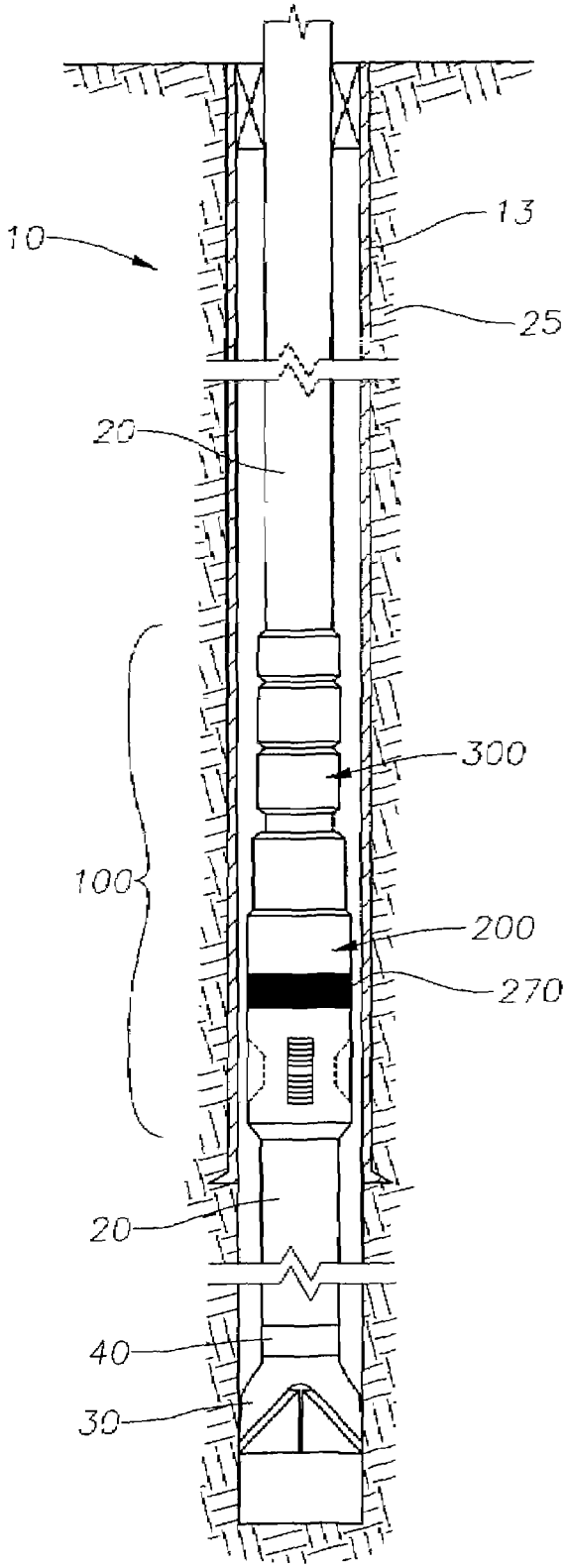
FIG. 1 is a cross-sectional view of a wellbore having a wellbore isolation apparatus of the present invention disposed therein. The wellbore isolation apparatus is attached at the lower end of a string of drill pipe in connection with a drilling operation, and is shown in side view. A drill bit is seen at the end of the drill pipe below the wellbore isolation apparatus.

FIG. 1 presents a cross-sectional view of a wellbore 10 having a wellbore isolation apparatus 100 of the present invention, in one embodiment, disposed therein. The wellbore isolation apparatus 100 is connected in series with a tubular string such as a string of drill pipe 20. The apparatus 100 is being used in connection with a wellbore operation. In the arrangement shown in FIG. 1, the wellbore operation is an underbalanced drilling operation. A wellbore operation tool, e.g., drill bit 30, is seen at the end of the drill pipe 20 below the wellbore isolation apparatus 100. Optional MWD equipment is shown schematically at 40.

In the wellbore 10 of FIG. 1, the formation has already been drilled to a first selected depth. A string of surface casing 15 has been cemented into the wellbore 10. A vertical layer of cured cement 25 is seen around the surface casing 15 within the formation 35. The formation 35 is being further drilled at a diameter smaller than the diameter of the surface casing 15. The drill string 20 and attached drill bit 30 are being pulled from the wellbore 10. In the exemplary view of FIG. 1, the drill bit 30 is being removed so that it can be replaced. However, it is understood that the present invention is not limited to this application, but has utility in any instance in which a wellbore operation tool is being removed from a wellbore during a wellbore operation. For example, the wellbore operation tool may be a mill, a mill/drill, an expandable bit, or other tool that is removed and in some way manipulated at the surface.

Figure 2A:
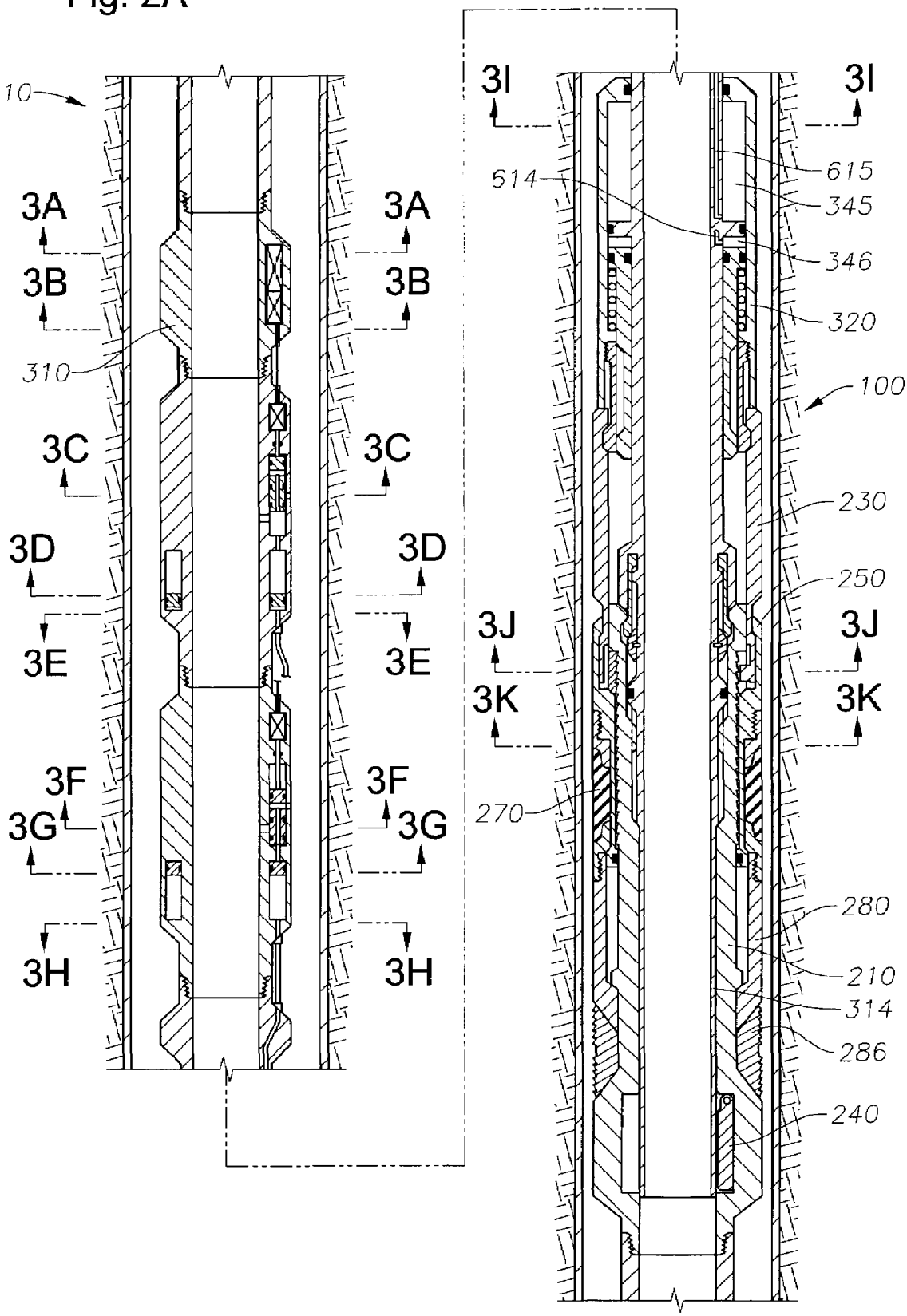
FIG. 2A is an enlarged cross-sectional view of the wellbore isolation apparatus used in the wellbore of FIG. 1, in one embodiment. In this view, the plug tool and the setting/releasing tool are seen connected together. The setting/releasing tool is in its released state.

The wellbore isolation apparatus 100 of FIG. 1 is shown in side view, and somewhat schematically. Further, the apparatus 100 and the wellbore 10 are not to scale. A more detailed view of the apparatus 100 is presented in FIG. 2A. FIG. 2A presents an enlarged, cross-sectional view of the wellbore isolation apparatus 100 used in the wellbore 10 of FIG. 1.

Figure 2B:
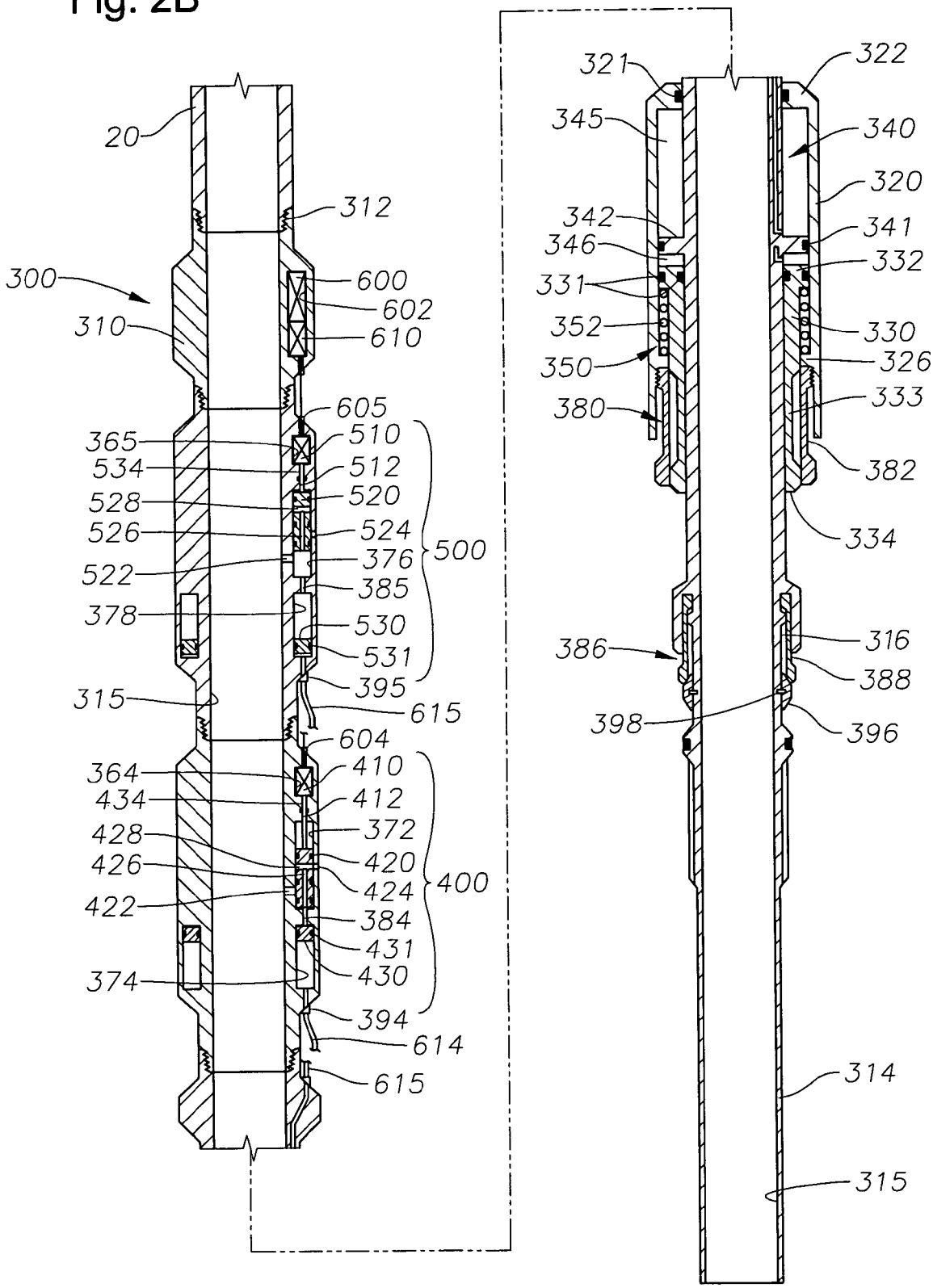
FIG. 2B presents the setting/releasing tool of FIG. 2A, alone.
Figure 2C:
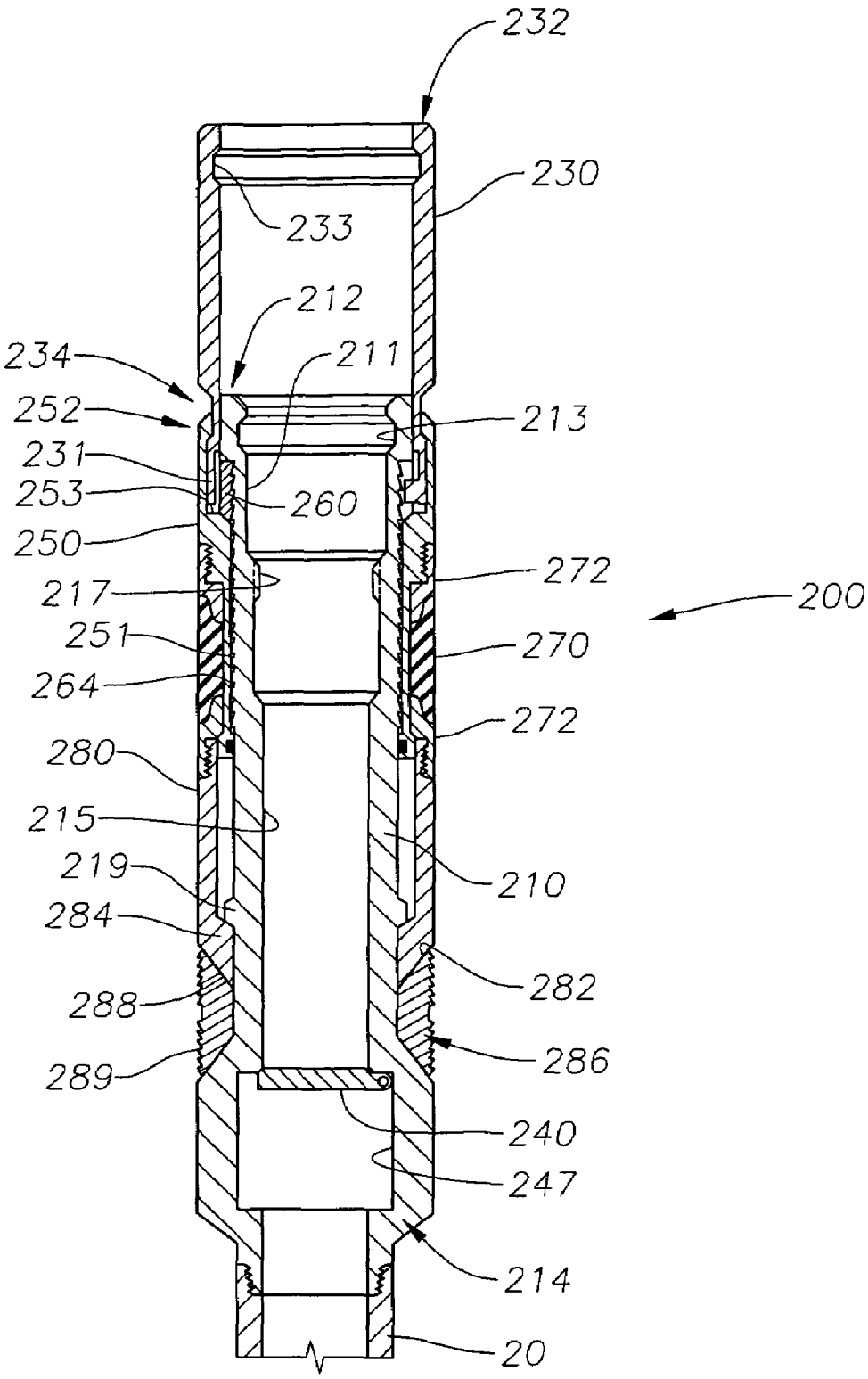
FIG. 2C presents the plug tool of FIG. 2A, alone.

The formation isolation apparatus 100 is made up of two separable tools. The first tool is a plug tool 200; the second tool is a setting/releasing tool 300 for selectively setting and releasing the plug tool 200 within the surrounding casing 15. In FIG. 2A, these two tools 200, 300 are shown connected to one another. However, for purposes of distinguishing, the respective tools 200, 300, FIGS. 2B and 2C are provided. FIG. 2B and FIG. 2C present the two tools 200, 300 separately. FIG. 2B is a cross-sectional view of the setting/releasing tool 300 alone, while FIG. 2C is a cross-sectional view of the plug tool 200 alone.

Referring to the setting/releasing tool 300 first, the setting/releasing tool 300 first comprises a solid inner mandrel 310. The solid inner mandrel 310 defines an elongated tubular member having a bore 315 therein. The top end of the inner mandrel 310 has a threaded connector 312 for connecting to a string of drill pipe 20. The bottom end of the inner mandrel 310 is a stinger 314. As will be described below, the stinger 314 will be used to selectively open and close a flapper valve 240 that is part of the bridge plug tool 200.

The setting/releasing tool 300 next comprises an outer sleeve 320. The outer sleeve 320 also defines a tubular body. The outer sleeve 320 is disposed around the inner mandrel 310 intermediate the top 312 and bottom 314 ends of the inner mandrel 310. The inner diameter of the outer sleeve 320 is generally larger than the outer diameter of the inner mandrel 310. However, the outer sleeve 320 has a top end 322 having a reduced inner diameter that is immediately adjacent to the outer surface of the inner mandrel 320. An o-ring 321 is provided to seal the interface between the top 322 of the outer sleeve 320 and the inner mandrel 310. The outer sleeve 320 also has a reduced diameter portion 326 having a top end and a bottom end. As will be shown, the reduced diameter portion 326 serves as a shoulder against which other tools are urged.

The setting/releasing tool 300 also includes a lock sleeve 330. The lock sleeve 330 also defines a tubular body. The lock sleeve 330 is nested intermediate the inner mandrel 310 and the outer sleeve 320. The lock sleeve 330 has a top end 332 having an enlarged diameter portion, and a bottom end 334. Seals 331 seal the interfaces between the lock sleeve 330 and the inner mandrel 310, and between the lock sleeve 330 and the outer sleeve 320. The lock sleeve 330 also has a reduced diameter portion 333. As will be shown below, the reduced diameter portion 333 is dimensioned to receive fingers 382 of a collet 380 when the collet 360 is released from an engaged position.

A first chamber area 340 is defined by the inner mandrel 310, the outer sleeve 320, the top end 322 of the outer sleeve 320, and the top end 332 of the lock sleeve 330. A shoulder 342 separates the chamber area 340 into two separate chambers. The upper chamber is designated as a releasing chamber 345; the lower chamber is designated as a setting chamber 346. In one arrangement, the shoulder 342 is an enlarged diameter portion of the inner mandrel 310. An o-ring 341 or other seal is placed around the shoulder 342 to seal the interface between the shoulder 342 and the inner diameter of the outer sleeve 320. In this way, the releasing chamber 345 and the setting chamber 346 are each fluidly sealed.

A second chamber area 350 is defined by the lock sleeve 330, the outer sleeve 320, the top end 332 of the lock sleeve 330, and the shoulder 326 of the outer sleeve 320. A spring 352 is disposed within the second chamber 350. The spring 352 is held in compression, and biases the lock sleeve 330 upwards.

The setting/releasing tool 300 operates to selectively set and release the plug tool 200 in the wellbore 10. In order to perform the setting and releasing functions, separate setting 400 and releasing 500 systems are incorporated into the setting/releasing tool 300. In the arrangement of FIGS. 2A and 2B, the setting 400 and releasing 500 systems are alternatively actuated in order to set or release the plug tool 200.

Figure 3A:
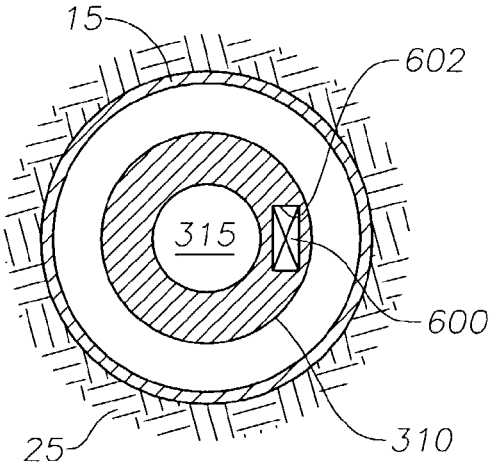
FIG. 3A is a cross-sectional view of the wellbore isolation apparatus of FIG. 2A. The view is taken across line A—A of FIG. 2A. A cross-sectional view of the battery is provided.

The setting system 400 and the releasing system 500 are driven by separate motors 410, 510, respectively. The setting system motor 410 is housed within a first motor recess 364 within the solid inner mandrel 310. The releasing system motor 510 is housed within a second motor recess 365, also within the inner mandrel 310. However, both the setting system motor 410 and the releasing system motor 510 are powered by the same power source 600. In the arrangement of FIGS. 2A and 2B, the power source is a battery 600. The battery 600 is housed within a battery recess 602. FIG. 3A presents a cross-sectional view of the setting/releasing tool 300. The view is taken across line A—A of FIG. 2A. A cross-sectional view of the battery 600 is seen. The tool 300 is also shown within a string of casing 15 from a wellbore 10.

The battery 600 is actuated from the surface. The battery 600 of FIGS. 2A and 2B includes a signal processor (shown schematically at 610) for receiving signals from the surface. The signals may be received through a cable (not shown), or may be wireless. An example of a wireless communication system is the use of an acoustic signal as might be used to communicate with an MWD apparatus.

Figure 3B:
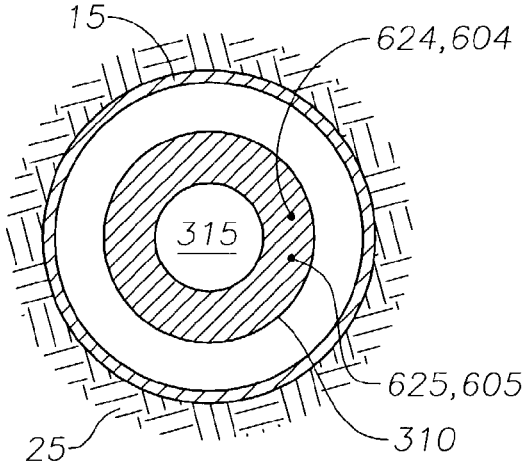
FIG. 3B presents a cross-sectional view of the wellbore isolation apparatus of FIG. 2A. The view is taken across line B—B of FIG. 2A. Recesses for receiving the two electrical lines are visible in the inner mandrel.

The battery 600 has two electrical lines 604, 605. A first electrical line 604 provides electrical communication between the battery 600 and the setting system motor 410; a second electrical line 605 provides electrical communication between the battery 600 and the releasing system motor 510. The electrical lines 604, 605 are disposed in suitable recesses 624, 625, respectively, within the inner mandrel 310. FIG. 3B is a cross-sectional view of the setting/releasing tool 300, taken across line B—B of FIG. 2A. The recesses 624, 625 for receiving the two electrical lines 604, 605 are visible in the inner mandrel 310.

The setting 400 and releasing 500 systems operate to inject fluid under pressure into the setting chamber 346 and into the releasing chamber 345, respectively. These functions are generally performed through hydraulically driven pistons 430, 530 that urge fluid into corresponding hydraulic lines 614, 615. As will be described below, the setting function of the setting/releasing tool 300 is accomplished by injecting fluid under pressure into the drill string 20 and against the hydraulically driven setting piston 430. The hydraulically driven setting piston 430, in turn, urges fluid through the hydraulic setting line 614 and into the setting chamber 346. Similarly, the releasing function of the setting/releasing tool 300 is accomplished by injecting fluid under pressure into the drill string 20 and against the hydraulically driven releasing piston 530. The hydraulically driven releasing piston 530, in turn, urges fluid through the hydraulic releasing line 615 and into the releasing chamber 345.

The setting 400 and releasing 500 systems of the setting/releasing tool 300 contain similar components. The components of the setting system 400 will be described first.

Figure 3C:
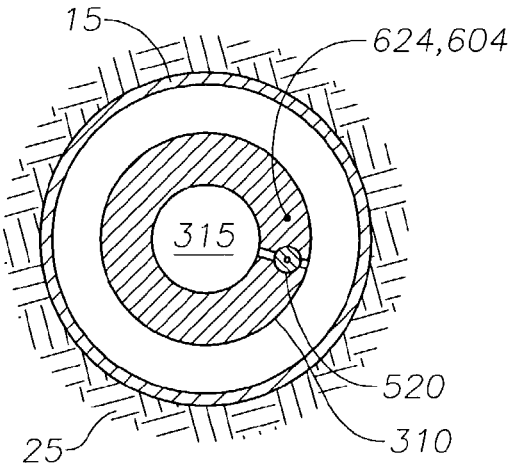
FIG. 3C also demonstrates a cross-sectional view of the wellbore isolation apparatus of FIG. 2A. The view is taken across line C—C of FIG. 2A. The view is taken across the first piston recess that receives the mechanically driven setting piston.
Figure 3D:
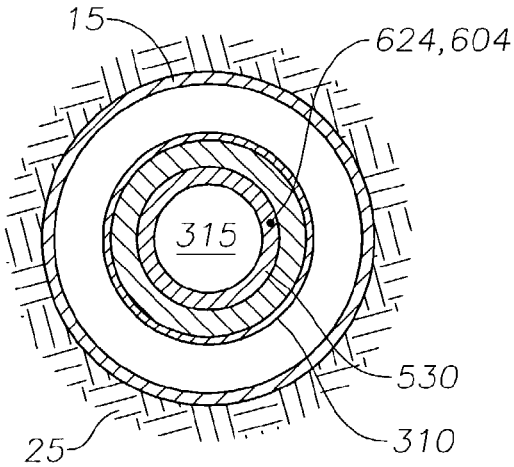
FIG. 3D provides yet another cross-sectional view of the wellbore isolation apparatus of FIG. 2A. The view is taken across line D—D of FIG. 2A. The view is taken across the second piston recess, which houses the hydraulically driven setting piston.

The setting system 400 first comprises a mechanically driven setting piston 420. The mechanically driven piston 420 for the setting system 400 is housed within a first piston recess 372 within the inner mandrel 310. The mechanically driven setting piston 420 is moveable from a raised position to a lowered position within the first piston recess 372. In the setting/releasing tool's 300 run-in position, shown in FIG. 2B, the mechanically driven setting piston 420 is in its lowered position such that it lowered near the bottom of the first piston recess 372. FIG. 3F is a cross-sectional view of the setting/releasing tool 300, taken across line F—F of FIG. 2A. Shown in this view is the first inner mandrel recess 372 that receives the mechanically driven setting piston 420. As will be described later, translation of the mechanically driven setting piston 420 within recess 372 is accomplished by actuating the setting motor 410.

The setting system 400 next comprises a hydraulically driven setting piston 430. The hydraulically driven piston 430 for the setting system 400 is housed within a second piston recess 374 within the inner mandrel 310. FIG. 3G is a cross-sectional view of the setting/releasing tool 300, taken across line G—G of FIG. 2A. The section is cut through the second piston recess 374, which houses the hydraulically driven setting piston 430. The hydraulically driven setting piston 420 is also moveable from a raised position to a lowered position within the first piston recess 374. In the view of FIG. 2B, the hydraulically driven setting piston 430 is in its raised position near the top of the second piston recess 374. This again is the run-in position for the setting/releasing tool 300.

The first and second setting piston recesses 372, 374 are placed in fluid communication above the hydraulically driven piston 420 by a hydraulic setting channel 384. The setting function of the setting/releasing tool 300 is performed when fluid travels from the wellbore 10, through the bore 315 of the inner mandrel 310, through the first piston recess 372, and through the hydraulic setting channel 384. Sealing members 431 seal the interfaces between the mechanically driven setting piston 420 and the first piston recess 372, and between the hydraulically driven setting piston 430 and the second piston recess 374.

In order to obtain fluid communication from the bore 315 of the inner mandrel 310 into the first piston recess 372, an inner recess channel 422 is provided in the first piston recess 372. The inner recess channel 422 is disposed proximate to the lower end of the first piston recess 372. The first piston recess 372 is in fluid communication with the bore 315 of the inner mandrel 310 when the mechanically driven piston 420 is in its raised position. This position is shown and desired later in connection with FIGS. 4A–4C. In this position, fluid may be injected under pressure from the surface, into the bore of the inner mandrel 310, and into the first piston recess 372. From there, fluid pressure is applied against the top of the hydraulically driven setting piston 430.

A reservoir of fluid is placed within the second piston recess 374 below the hydraulically driven setting piston 430. Also, the lower end of the piston recess 374 includes a port 394 that is connected to hydraulic setting line 614. When pressure is applied to the top of the hydraulically driven setting piston 430, the reservoir of fluid is extruded through the hydraulic setting line 614 and into the setting chamber 346. This position is again shown in the cross-sectional views of FIGS. 4A–4C. In this way, the setting function for setting the plug tool 200 is actuated.

It will be noted that wellbore fluids will remain above the hydraulically driven setting piston 430 even after the plug 200 has been set. Later, when the mechanically driven setting piston 420 is returned to its raised position, it is desirable to be able to bleed off the wellbore fluids above the hydraulically driven piston 430 without having to adjust wellbore pressure. To this end, an outer recess channel 424 is provided within the first piston recess 372. The outer recess channel 424 is disposed above the inner recess channel 422 in the inner mandrel 310 wall.

To further aid in bleeding off fluid pressure above the hydraulically driven setting piston 430, a pair of bores 426, 428 are placed in the mechanically driven setting piston 420. The first bore 426 extends along the longitudinal axis of the piston 420, and opens at the bottom end of the piston 420. The second bore 428 is disposed essentially perpendicular to the longitudinal axis of the piston 420 at the top of the first bore 426. The second bore 428 is in fluid communication with the outer recess channel 424 and the annulus around the setting/releasing tool 300 when the mechanically driven setting piston 420 is stroked downward.

Figure 4A:
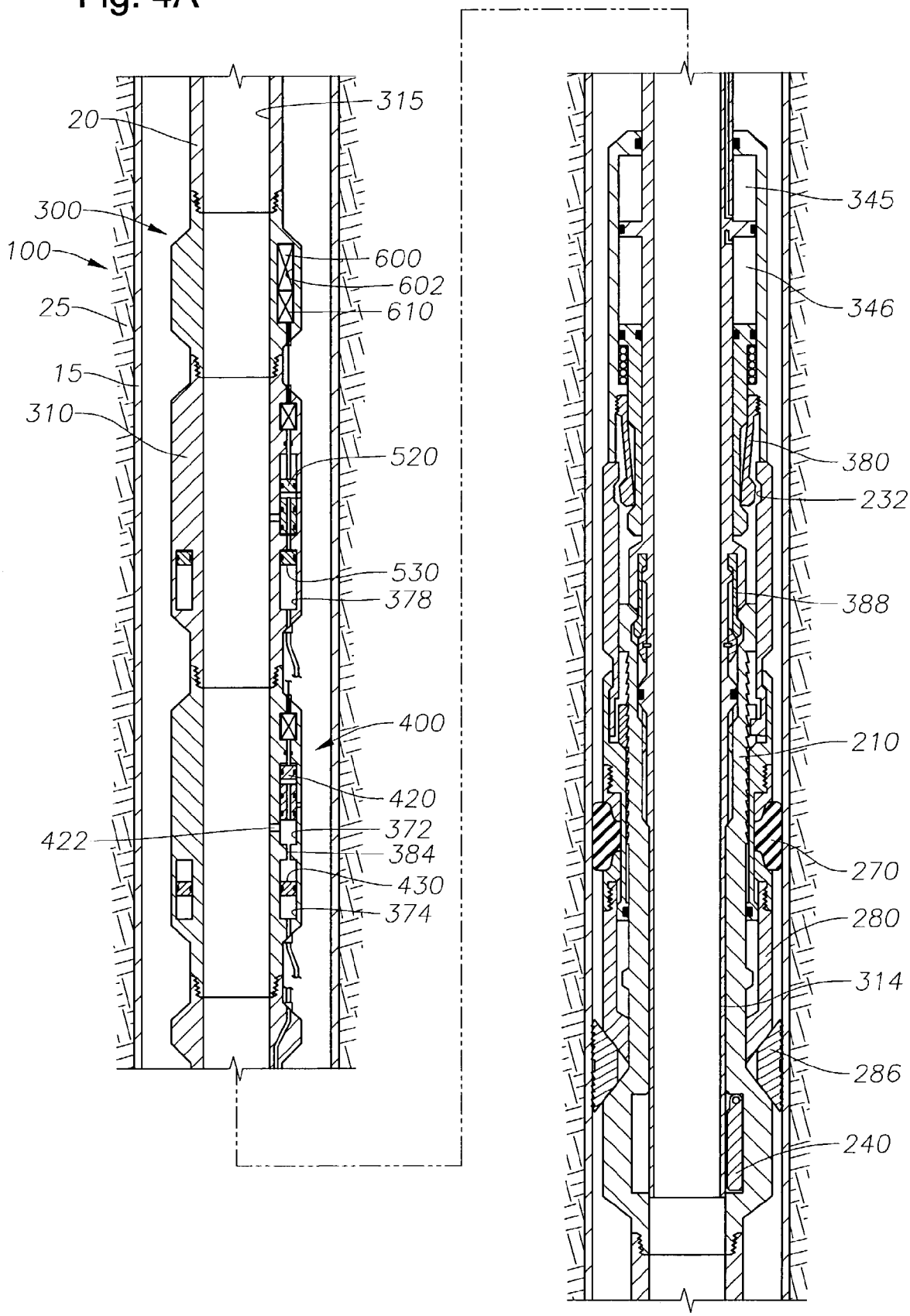
FIG. 4A presents a cross-sectional view of the wellbore isolation apparatus of FIG. 2A. In this view, the plug tool has been set in the surrounding casing, and the setting/releasing tool is being released from the plug tool.
Figure 4B:
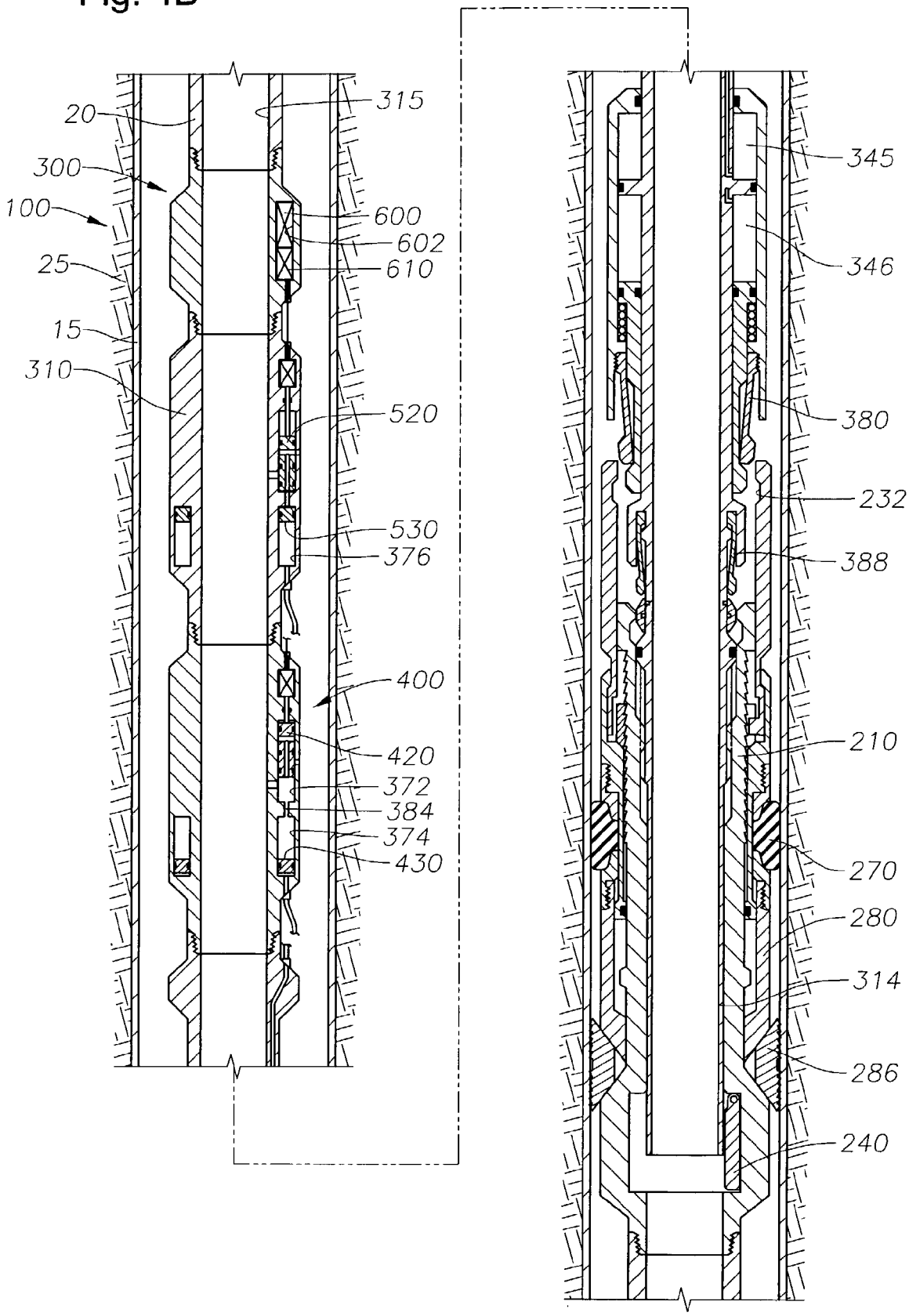
FIG. 4B presents a cross-sectional view of the wellbore isolation apparatus of FIG. 4A, with the setting/releasing tool being further released from the plug tool.

As noted, the mechanically driven setting piston 420 is moved between raised and lowered positions. In the arrangement of FIGS. 4A and 4B, this translation is accomplished by actuating the setting motor 410. The setting motor 410 is mechanically connected to the mechanically driven setting piston 420. In one arrangement, the setting motor 410 is a rotary motor that drives a helically threaded setting auger 412. The auger 412 is connected at one end to the setting motor 410, and is connected at the other end to a nut (not shown) within the mechanically driven piston 420. Intermediate the first motor recess 364 and the first piston recess 372, the setting auger 412 is received within a setting auger channel 434 within the inner mandrel 310. A sealing member 431 seals the interface between the setting auger 412 and the setting auger channel 434. When the setting motor 410 is actuated by receiving the appropriate signal from the signal processor 610, the setting auger 412 is rotated so as to drive the mechanically driven setting piston 420 from the bottom of the first piston recess 372 upward. Reciprocally, the setting motor 410 may receive a signal from the surface to return the mechanically driven setting piston 420 to its lowered position within the first piston recess 372.

The inner mandrel 310 extends below the second piston recess 374. FIG. 3I is a cross-sectional view of the setting/releasing tool 300, taken across line I—I of FIG. 2A. The two hydraulic lines 614, 615 are seen within recesses in the inner mandrel 310. The spaced apart relation of the inner mandrel 310 and the outer sleeve 320 for the setting/releasing tool 300 is also seen. The two hydraulic lines 614, 615 deliver hydraulic fluid to the setting chamber 346 and the releasing chamber 345, respectively.

In the arrangement of FIG. 2A, the components for the setting system 400 are generally disposed below the components for the releasing system 500. However, it is understood that the relative placement of the setting 400 and the releasing 500 systems may be reversed, so long as the hydraulic lines 614, 615 are distributed to the proper area of the first chamber area 340; i.e., chambers 346 and 345, respectively. The structure for the releasing system 500 is substantially similar to the structure described above for the setting system 400. In this request, the releasing system 500 first comprises a mechanically driven releasing piston 520. The mechanically driven piston 520 for the releasing system 500 is housed within a third piston recess 376 within the inner mandrel 310. FIG. 3C presents a cross-sectional view of the setting/releasing tool 300, taken across line C—C of FIG. 2A. The view is taken across the first piston recess 376.

The mechanically driven releasing piston 520 is moveable from a raised position to a lowered position within the third piston recess 376. As with the mechanically driven setting piston 420, translation of the mechanically driven releasing piston 520 is accomplished by actuating a motor. In this instance, the motor is the releasing motor 510. In the setting/releasing tool's 300 run-in position, the mechanically driven releasing piston 520 is preferably in its raised position such that it resides near the top of the third piston recess 376.

The releasing system 500 next comprises a hydraulically driven releasing piston 530. The hydraulically driven piston 530 for the releasing system 500 is housed within a fourth piston recess 378 within the inner mandrel 310. FIG. 3D provides a cross-sectional view of the setting/releasing tool 300, taken across line D—D of FIG. 2A. The fourth piston recess 378, which houses the hydraulically driven releasing piston 530, is seen in cross-section. The hydraulically driven releasing piston 530 is moveable from a raised position to a lowered position within the fourth piston recess 378. In the view of FIGS. 2A and 2B, the hydraulically driven releasing piston 530 is in its lowered position near the bottom of the fourth piston recess 378. This again is the run-in position for the setting/releasing tool 300.

The third and fourth piston recesses 376, 378 are placed in fluid communication above the hydraulically drive piston 530 by a hydraulic setting channel 385. The releasing function of the setting/releasing tool 300 is performed when fluid travels from the wellbore 10, through the bore 315 of the inner mandrel 310, through the third piston recess 376, and through the hydraulic releasing channel 385. Sealing members 531 seal the interfaces between the mechanically driven releasing piston 520 and the third piston recess 376, and between the hydraulically driven setting piston 530 and the fourth piston recess 378.

In order to obtain fluid communication from the bore 315 of the inner mandrel 310 into the third piston recess 376, an inner recess channel 522 is provided in the third piston recess 372. The inner recess channel 522 is disposed proximate to the lower end of the third piston recess 376. The third piston recess 376 is in fluid communication with the bore 315 of the inner mandrel 310 when the mechanically driven piston 520 is in its raised position. This is the position shown in FIG. 2A. In this position, fluid may be injected under pressure from the surface, into the bore of the inner mandrel 310, and into the third piston recess 376. From there, fluid pressure flows through the hydraulic releasing channel 385 and is applied against the top of the hydraulically driven releasing piston 530.

A reservoir of fluid is placed within the fourth piston recess 374 below the hydraulically driven releasing piston 530. Also, the lower end of the piston recess 378 includes a port 395 that is connected to hydraulic releasing line 615. When pressure is applied to the top of the hydraulically driven releasing piston 530, the reservoir of fluid is extruded through the hydraulic releasing line 615 and into the releasing chamber 345. This position is shown in the cross-sectional views of FIGS. 2A and 2B. In this way, the releasing function for setting the plug tool 200 is actuated.

Figure 3E:
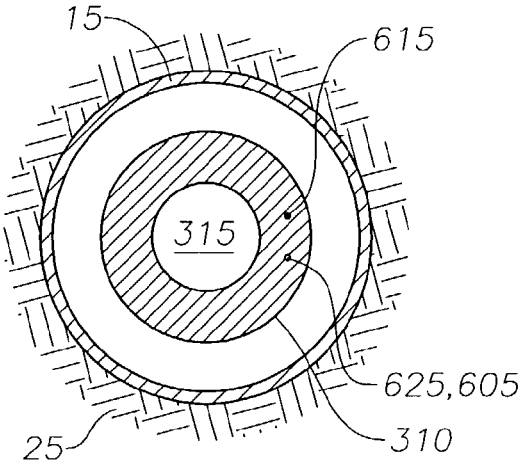
FIG. 3E also presents a cross-sectional view of the wellbore isolation apparatus of FIG. 2A. The view is taken across line E—E of FIG. 2A. Recesses for receiving the electrical setting line and the hydraulic releasing line are visible in the inner mandrel.
Figure 3F:
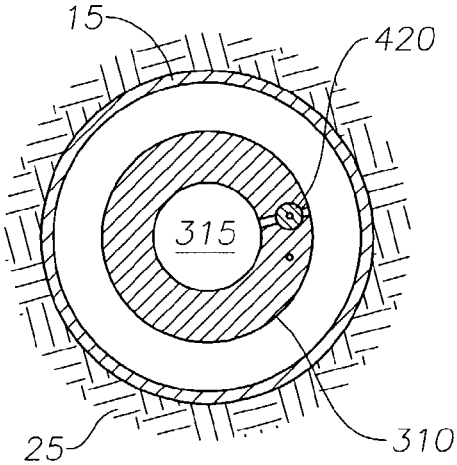
FIG. 3F is an additional cross-sectional view of the wellbore isolation apparatus of FIG. 2A. The view is taken across line F—F of FIG. 2A. Shown in this cross-sectional view is the first inner mandrel recess that receives the mechanically driven setting piston.
Figure 3G:
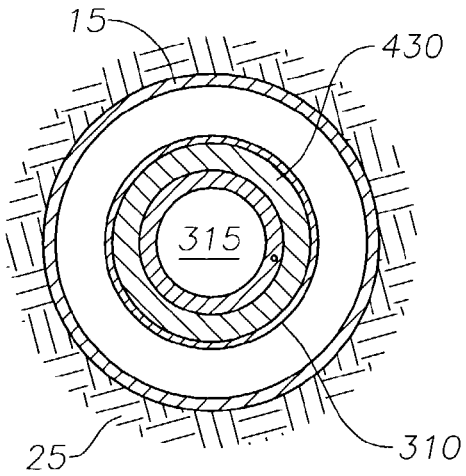
FIG. 3G shows still another cross-sectional view of the wellbore isolation apparatus of FIG. 2A. The view is taken across line G—G of FIG. 2A. The fourth inner mandrel recess, which houses the hydraulically driven releasing piston, is seen in cross-section.

FIG. 3E is a cross-sectional view of the setting/releasing tool 300, taken across line E—E of FIG. 2A. The electrical setting line 604 and the hydraulic releasing line 615 are visible in the inner mandrel 310.

In connection with the releasing operation, it will be noted that wellbore fluids will remain above the hydraulically driven releasing piston 530 after the plug tool 200 has been released. Accordingly, it is desirable to be able to bleed off the wellbore fluids above the hydraulically driven piston 530 as wellbore pressure is reduced. To this end, an outer recess channel 524 is also provided within the third piston recess 376. The outer recess channel 524 is disposed above the inner recess channel 522, and in the wall of the inner mandrel 310 adjacent the annulus formed by the inner mandrel 310 and the surface casing 15 (or formation).

To aid in bleeding off fluid pressure above the hydraulically driven releasing piston 530, a pair of bores 526, 528 are place in the mechanically driven releasing piston 520. The first bore 526 extends along the longitudinal axis of the piston 520, and opens at the bottom end of the piston 520. The second bore 528 is disposed essentially perpendicular to the longitudinal axis of the piston 520 at the top of the first bore 526. The second bore 528 is in fluid communication with the outer recess channel 524 and the annulus around the setting/releasing tool 300 when the mechanically driven setting piston 520 is stroked downward.

As noted, the mechanically driven releasing piston 520 is moved between raised and lowered positions. In the arrangement of FIGS. 2A, 2B and 4A–4C, this translation is accomplished by actuating the setting motor 510. The setting motor 510 is mechanically connected to the mechanically driven releasing piston 520. In one arrangement, the releasing motor 510 translates the mechanically driven releasing piston 520 in the same way that the setting motor 410 translates the mechanically driven setting piston 420. To this end, the releasing motor 510 defines a rotary motor that drives a helically threaded auger 512. The auger 512 is connected at one end to the releasing motor 510, and is connected at the other end to a nut (not shown) within the mechanically driven releasing piston 520. Intermediate the second motor recess 364 and the third piston recess 376, the auger 512 is received within a releasing auger channel 534 within the inner mandrel 310. A sealing member seals the interface between the auger 512 and the releasing auger channel 534.

When the releasing motor 510 is actuated by receiving the appropriate signal from the signal processor 610, the releasing auger 512 is rotated so as to drive the mechanically driven releasing piston 520 from the top of the third piston recess 376 downward. Reciprocally, the releasing motor 510 may receive a signal from the surface to return the mechanically driven releasing piston 520 to its raised position within the third piston recess 376.

As noted, different signals from the surface are used to tell the battery 600 to: (1) turn on the setting system motor 410 to raise the mechanically driven setting piston 420; (2) turn on the setting system motor 410 to lower the mechanically driven setting piston 420; (3) turn on the releasing system motor 510 to lower the mechanically driven releasing piston 520; and (4) turn on the releasing system motor 510 to raise the mechanically driven releasing piston 520. When the battery 600 receives the various signals, the signals are sent to the setting 410 or receiving 510 motor through the appropriate electrical line, 604 or 605, to provide the corresponding power and instruction.

The setting/releasing tool 300 is releasably connected to the plug tool 200. Thus, the setting/releasing tool 300 further comprises two connectors 380, 386 for releasably connecting the setting/releasing tool 300 from the plug 200. In the arrangement of FIG. 2A, the connectors 380, 386 each define a collet.

The first collet 380 is an upper setting sleeve collet 380. The upper setting sleeve collet 380 defines a tubular body having a plurality of fingers 382 extending downward. The body of the upper setting sleeve collet 380 is nested between the lock sleeve 330 and the outer sleeve 320. The body of the upper setting sleeve collet 380 is more specifically disposed immediately below the shoulder 326 of the outer sleeve 320. In one aspect, the upper setting sleeve collet 380 is threadedly connected to the outer sleeve 320 below the shoulder 326. The fingers 382 of the upper setting sleeve collet 380 extend below the outer sleeve 320 and are adjacent the bottom end 334 of the lock sleeve 330. The upper setting sleeve collet fingers 382 are biased to retract inward, but are held outward by the lower end 334 of the lock sleeve 330 when the setting/releasing tool 300 is in its released state.

The second collet 386 is disposed below the first collet 380 along the inner mandrel 310. The second collet serves as a plug body collet 386, and also defines a tubular body having a plurality of fingers 388 extending downward. A collet recess 316 is provided in the inner mandrel 310 for receiving the body of the plug body collet 386. As with fingers 382 of the first collet 380, the fingers 388 of the second (plug body) collet 386 are biased inward. The fingers 388 of the plug body collet 386 are maintained in an outward position by a cam shoulder 396 placed along the inner mandrel 310 below the fingers 388. The cam shoulder 396 is releasably held to the inner mandrel 310 by a shearable connection, such as a shear pin 398.

As noted, the upper setting sleeve collet 380 and the plug body collet 386 serve as releasable connectors between the setting/releasing tool 300 and the plug tool 200. Before disclosing the operation of the upper setting sleeve collet 380 and the plug body collet 386, it is appropriate to describe the components of the plug tool 200.

FIG. 2C presents the plug tool 200 of FIG. 2A, alone, for purposes of clarity. The tool 200 is shown in cross-section. As shown, the plug tool 200 first comprises a plug body 210. The plug body 210 defines an elongated tubular member having a bore 215 therethrough. The plug body 210 has an upper end 212 that includes an inner profile 213. A reduced outer diameter portion 211 is provided on the plug body 210 below the upper end 212. As will be shown, the reduced outer diameter portion 211 serves as a shoulder against which other plug tool 200 components are urged.

The surface of the reduced outer diameter portion 211 includes a plurality of teeth 264. The teeth 264 serve as ratcheting teeth for receiving a snap ring 260. The snap ring 260 is circumferentially disposed about the plug body 210. As will be shown, the snap ring 260 rides on the teeth 264 when the plug 200 is being set in the wellbore 10.

The plug body 210 has a lower end 214. The lower end is preferably threaded to a bottom hole assembly for a drilling operation, such as the MWD equipment 40 and the drill bit 30. The lower end 214 of the plug body 210 also has an inner profile 247. The inner profile 247 receives a flapper valve 240.

One or more lugs 217 are radially placed around the inner diameter of the plug body 210. The lugs 217 serve as splines for receiving a mating profile (not shown) at the lower end of the drill string 20. In this way, the wellbore isolation apparatus 100 may be rotated with the drill string 20 during an underbalanced drilling operation. FIG. 3K provides a cross-sectional view of the wellbore isolation apparatus 100, with the view taken across line K—K. The lugs 217 for latching into the drill pipe 20 are visible in this view.

The plug body 210 also has a shoulder 219 proximate the bottom end 214. The shoulder 219 defines an enlarged outer diameter portion. As will be shown, the shoulder 219 assists in holding an upper cone 280 member in place.

The plug tool 200 next comprises an upper setting sleeve 230. The upper setting sleeve 230 is a tubular body having an upper end 232 and a lower end 234. The upper end includes an inner profile portion 233. The lower end 234 includes a reduced outer diameter portion 231. The lower end 234 extends down below the top end 212 of the plug body 210 and the upper end of the reduced diameter portion 211.

The plug tool 200 also comprises a lower setting sleeve 250. The lower setting sleeve 250 is a tubular body having an upper end 252. The upper end of the lower setting sleeve 250 defines a neck 252 that extends over the lower end 234 of the upper setting sleeve 230, and is received by the reduced outer diameter portion 231 of the upper setting sleeve 230. The lower setting sleeve 250 includes a reduced inner diameter portion 251 that creates a shoulder 253. The bottom end 234 of the upper setting sleeve 230 pushes down on the shoulder 253 of the lower setting sleeve 250 when the plug tool 200 is set in the wellbore 10.

The bottom end 251 of the lower setting sleeve 250 receives a sealing element 270. The sealing element 270 is fabricated from an elastomeric or other pliable material. The sealing element 270 is urged outwardly away from the lower setting sleeve 250 when the plug tool 200 is being set in the wellbore 10. In this way, a fluid seal is accomplished between the plug 200 and the surrounding casing 15.

Preferably, gauge rings 272 are disposed above and below the sealing element 270. The gauge rings 272 each define tubular members that radially encompass the lower setting sleeve 250 immediately above and below the sealing element 270. In one aspect, the gauge rings 272 are bonded to the sealing element 270. In this way, the sealing element 270 is more readily retracted back against the lower setting sleeve 250 when the plug 200 is returned from a set position (FIG. 4C) to a released position (FIG. 2A).

The plug tool 200 also comprises a cone 280. The cone 280 defines a tubular body having a beveled surface 282. The beveled surface 282 is configured to ride under an anchoring slip 286. The cone 280 has an upper end 282 that is connected to the sealing element 270. In the arrangement of FIG. 2A, the connection is made via the lower gauge ring 272. The cone 280 also has a lower portion 284 that extends below the shoulder 219 in the plug body 210. As noted above, the shoulder 219 assists in maintaining the cone 280 in place.

The anchoring slip 286 of the plug tool 200 is disposed below the beveled surface 282 of the cone 280. The anchoring slip 286 has a matching upper beveled surface 288 that rides outward on the cone 280 when the setting/releasing tool 300 is actuated in order to set the plug 200 in the wellbore 10. A common track-type system (not shown) is used to assist the anchoring slip 286 in riding up and down the cone 280. The anchoring slip 286 includes wickers 289 on the outer edge, that serve to "bite" the surrounding casing, e.g., casing 15, when the anchoring slip 286 is urged outward along the cone 280. This, in turn, holds the bridge plug 200 in place when the setting system 400 is actuated.

The plug 200 is designed to be "multi-set." This means that the sealing element 270 and the anchoring slip 286 are capable of being retracted, thereby being released from contact with the surrounding casing string 15 when the releasing system 500 is actuated. Thus, when fluid is injected into the releasing chamber 345, the plug 200 is released from the surrounding casing 20, and may be rotated or pulled. As will be shown, the plug 200 can later be reset in the wellbore 10.

As noted previously, the setting/releasing tool 300 is releasably connected to the plug tool 200. An upper setting sleeve collet 380 and a plug body collet 386 were described as defining the two releasable connectors. The fingers 382 of the upper setting sleeve collet 380 reside within the inner profile 233 of the upper setting sleeve 230 in the tool's 100 run-in position. More specifically, the fingers 382 are secured against the inner profile 233 in the released position (shown in FIG. 2A) by the lower end 334 of the lock sleeve 330. Similarly, the fingers 388 of the plug body collet 386 are landed in the inner profile 213 of the plug body 210 in the tool's 100 run-in position. More specifically, the fingers 388 are secured against the inner profile 213 in the released position (shown in FIG. 2A) by the cam shoulder 396 placed along the inner mandrel 310.

In operation, the wellbore isolation apparatus 100 is run into the wellbore 10 as part of a drilling or other operation. The apparatus 100 is in its released state, as shown in FIG. 2A. The apparatus 100 is rotationally locked with the drill string 20, as shown in FIG. 3K. At some point, it is desirable to remove the drill string 20 from the wellbore 10. This may be in connection with the changing of the drill bit 30, or because the operator desires to run in a new string of casing, such as a liner, for example. In that instance, the operator will begin pulling the drill sting 20 and the attached wellbore isolation apparatus 100.

As described above, the pipe 20 cannot be completely removed from the wellbore 10 during an underbalanced drilling operation without becoming "pipe light." Therefore, before the drill string 20 is completely removed, the setting/releasing tool 300 is actuated so as to set the plug 200 in the surface casing 15 (or wellbore generally). Typically, this is done when 1,000 to 1,500 feet of drill pipe 20 remain in the wellbore 10. The setting/releasing tool 300 can then be removed from the plug 200, allowing the flapper valve 240 to open, and thereby isolating the upper wellbore from formation pressures.

To accomplish this, a signal is sent to the battery 600 to raise the mechanically driven setting piston 420. The mechanically driven setting piston 420 is then raised within the first piston recess 372 so as to clear the inner recess channel 422 and to expose the second piston housing 374 to wellbore pressure within the bore 315 of the mandrel 310.

Also, a signal is sent to the battery 600 to lower the mechanically driven releasing piston 520. The mechanically driven releasing piston 520 is then lowered within the third piston recess 376 so as to seal the inner recess channel 522. Fluid pressure then may not act on the hydraulically driven releasing piston 530.

Next, fluid is injected into the drill string 20 under pressure. This forces wellbore fluids into the second piston recess 374 above the hydraulically driven setting piston 430. From there, fluids act downward against the hydraulically driven setting piston 430, and force hydraulic fluids residing below the hydraulically driven setting piston 430 through the hydraulic setting line 614.

Figure 3H:
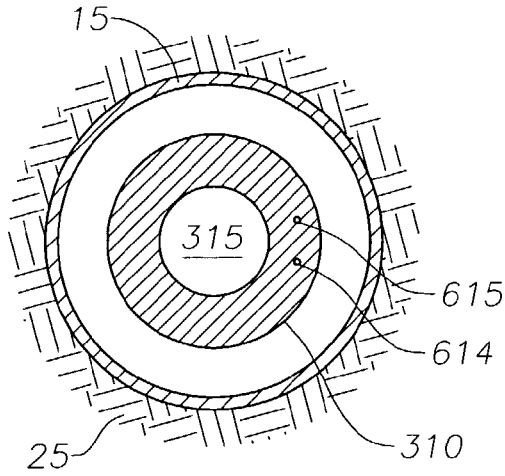
FIG. 3H provides yet another cross-sectional view of the wellbore isolation apparatus of FIG. 2A. The view is taken across line H—H of FIG. 2A. Recesses for receiving the two hydraulic lines are visible in the inner mandrel.
Figure 3I:
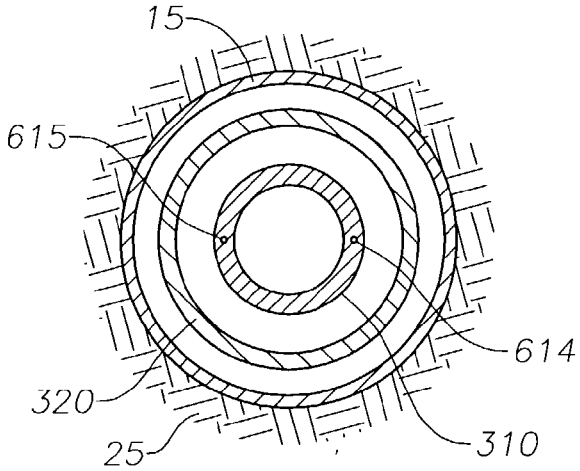
FIG. 3I also demonstrates a cross-sectional view of the wellbore isolation apparatus of FIG. 2A. The view is taken across line I—I of FIG. 2A. Recesses for receiving the two hydraulic lines are again seen in the inner mandrel. The spaced apart relation of the inner mandrel and the outer sleeve for the setting/releasing tool is seen.

FIG. 3H is a cross-sectional view of the wellbore isolation apparatus 100, taken across line H—H of FIG. 2A. The two hydraulic lines 614, 615, are visible in the inner mandrel 310. During a setting operation, hydraulic fluid travels through the hydraulic setting line 614 and enters the setting chamber 346. As pressure builds, the lock sleeve 330 moves downward, overcoming the upward bias of the spring 352 in second chamber area 350. As the lock sleeve 330 moves downward, the lower end 334 of the lock sleeve 330 clears the fingers 382 of the upper setting sleeve collet 380. This allows the fingers 382 to snap inward. This, in turn, releases the connection between the upper setting sleeve collet 380 and the upper setting sleeve 230 of the bridge plug 200.

As pressure continues to build in the setting chamber 346, the outer sleeve 320 also moves downward relative to the inner mandrel 310. This triggers a chain of downward forces. First, the outer sleeve 320 acts downwardly on the upper setting sleeve 230; the upper setting sleeve 230 acts downwardly on the lower setting sleeve 250; and the lower setting sleeve 250 acts downwardly on the gauge rings 272 and the sealing element 270. The upper setting sleeve 230 and the lower setting sleeve 250 are able to move downwardly relative to the plug body 210 of the plug 200. The position of the upper setting sleeve 230 and the lower setting sleeve 250 are held relative to the position plug body 210 by teeth 264 that catch the snap ring 260.

The gauge rings 272 and the sealing element 270 are also able to move downwardly relative to the plug body 210, at least initially. However, the sealing element 270 is eventually urged outwardly into contact with the surrounding surface casing 15 due to the counteracting force of the upper cone 280, as described above. In addition, the downward force generated through the gauge rings 272 and the sealing element 270 causes the cone 280 to urge the anchoring slip 286 outward into frictional contact with the surrounding surface casing 15.

After the sealing element 270 and the anchoring slip 286 have been set in the wellbore 10, additional pressure continues to be applied through the drill string 20. This causes the fingers 388 of the plug body collet 386 to act downwardly against the cam shoulder 396 along the inner mandrel 310 . Ultimately, the shear pin 398 in the cam shoulder 396 is sheared. This, in turn, releases the fingers 388 from the inner profile 213 at the top 212 of the plug body 210. At that point, the setting/releasing tool 300 has been completely freed from the set plug tool 200.

After the setting/releasing tool 300 has been released from the set plug 200, the setting/releasing tool 300 is pulled from the wellbore 10. Raising the setting/releasing tool 300 further in the wellbore 10 causes the stinger 314 at the bottom of the inner mandrel 310 to clear the flapper valve 240. Once the flapper valve 240 is cleared, it is free to open. In this respect, the flapper valve 240 is biased to its closed position. When the flapper valve 240 is closed, the upper wellbore 10 is isolated from formation pressures below the flapper valve 240.

FIG. 4A presents a cross-sectional view of the wellbore isolation apparatus 100 of FIG. 2A, with the mechanically driven setting piston 420 having been moved to its raised position within the first piston recess 372. Likewise, the mechanically driven releasing piston 520 has been moved to its lower position within the third piston recess 376. In this way, fluids can be injected under pressure through the bore 315 of the setting/releasing tool 300, and into the setting system 400. More specifically, fluids travel through the inner recess channel 422, into the first piston recess 372 below piston 420, through the fluid channel 384, and into the second piston recess 374 above piston 430. In the view of FIG. 4A, the hydraulically driven setting piston 430 is being moved downward within the second piston recess 374.

FIG. 4B shows the wellbore isolation apparatus 100 of FIG. 4A, with the setting system 400 being further activated. Hydraulic pressure above the hydraulically driven setting piston 430 has moved that piston 430 to its full downward position within the second piston recess 374. This, in turn, has forced the fluid reservoir residing within the second piston recess 374 below the hydraulically driven setting piston to be extruded into the hydraulic setting line 614. This feeds fluid under pressure into the setting chamber 346. As described above, this begins the process for setting the plug tool 200 into the wellbore 10, and for releasing the setting/releasing tool 300 from the plug tool 200.

It can be seen in FIG. 4B that the upper setting sleeve collet 380 and the plug body collet 386 have been released from the upper setting sleeve profile 233 and the plug body profile 213, respectively. This releases the setting/releasing tool 300 from the plug tool 200, allowing the setting/releasing tool 350 to be independently pulled from the wellbore 10. It is also seen in FIG. 4B that the sealing element 270 has been extruded outward into sealed engagement with the surrounding casing 15.

Figure 4C:
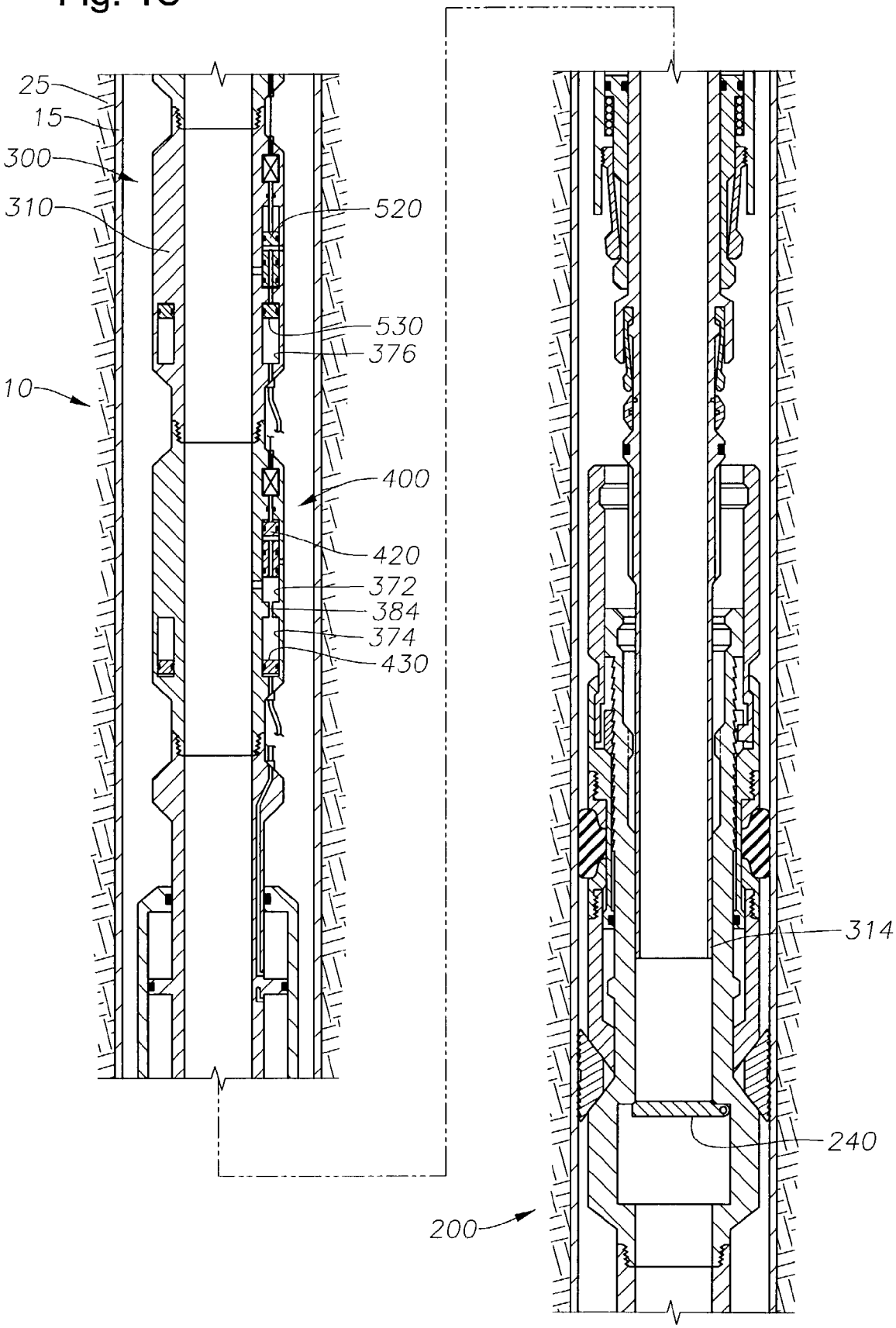
FIG. 4C presents a cross-sectional view of the wellbore isolation apparatus of FIG. 4B, having been released from the plug tool so as to allow the flapper valve to close.

FIG. 4C demonstrates the setting/releasing tool 300 being pulled from the wellbore 10. In this view, the stinger 314 at the lower end of the inner mandrel 310 has cleared the flapper valve 240. This allows the flapper valve 240 to slam into its closed position, as show in FIG. 4C. The plug tool 200 remains in its set state within the wellbore 10 while the setting/releasing tool 300 is pulled.

Figure 5:
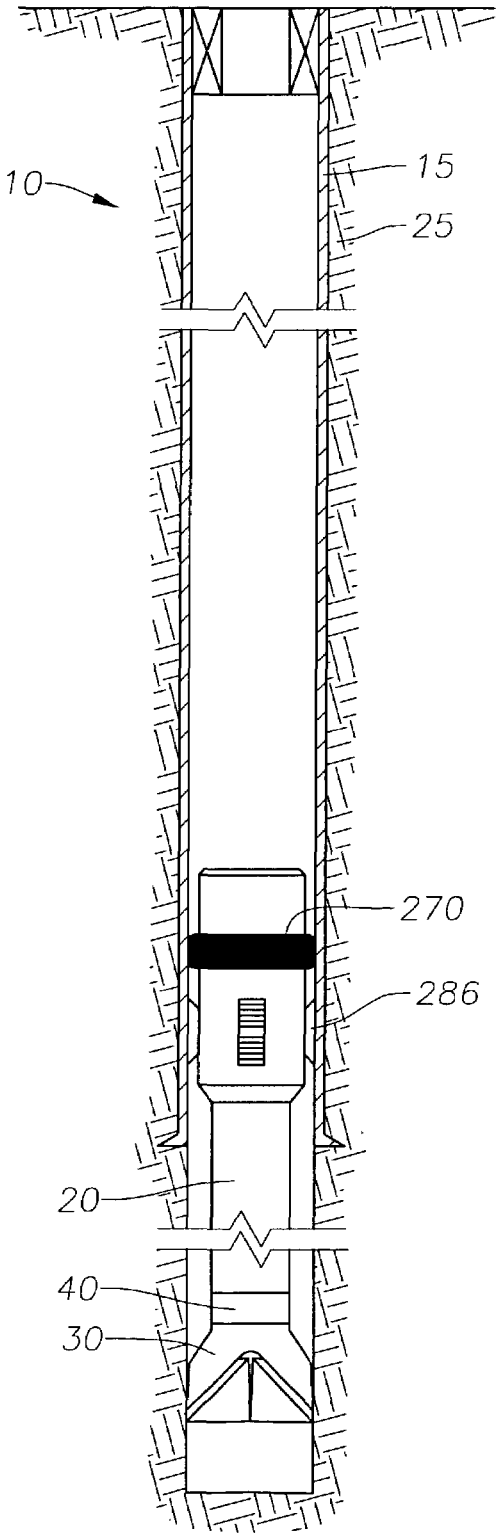
FIG. 5 is a cross-sectional view of the wellbore of FIG. 1. In this drawing, the drill string has been removed from the wellbore along with the setting/releasing tool of the wellbore isolation apparatus. The plug tool remains set in the wellbore, isolating pressure in the formation from the surface.

FIG. 5 provides a cross-sectional view of the wellbore 10 of FIG. 1. In this view, the setting/releasing tool 300 has been removed from the wellbore 10. The plug tool 200 again remains set in the wellbore 10. It can be seen that the sealing element 220 is in sealed engagement with the surrounding surface casing string 15.

Figure 6:
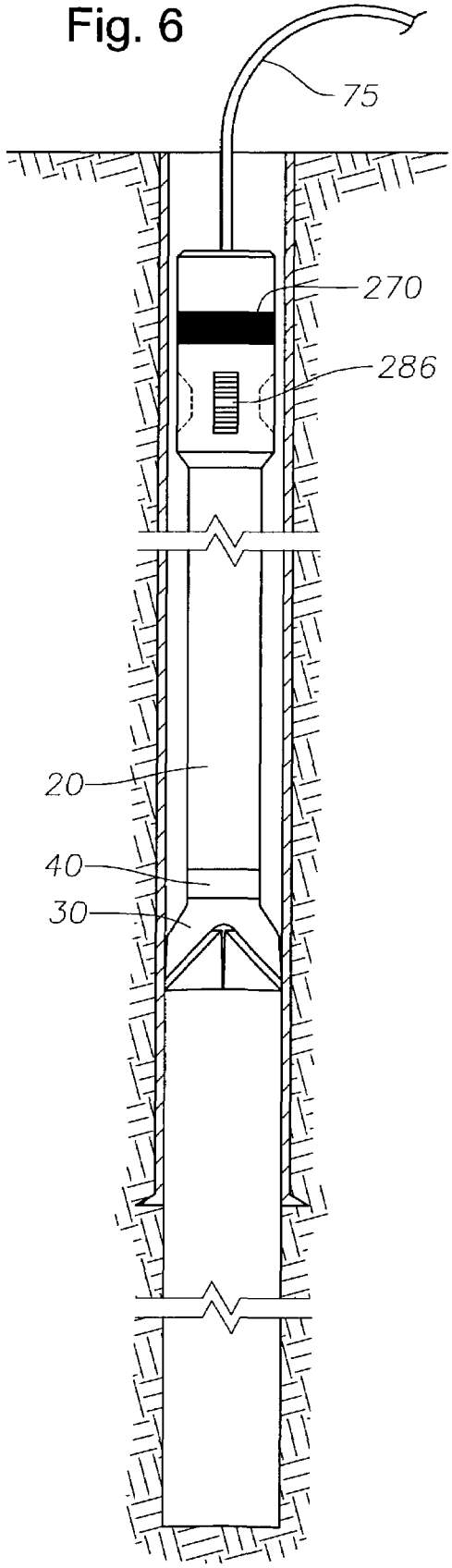
FIG. 6 is a cross-sectional view of the wellbore of FIG. 5. The bridge plug has been released from the surrounding surface casing. The bridge plug is now being rapidly retrieved from the wellbore by pulling it on a wireline. The drill bit is pulled with the plug tool.

It will be necessary to retrieve the set plug 200 from the wellbore 10. To accomplish this, a fishing tool (not shown) may be quickly run back into the wellbore 10 on a wireline 75. The fishing tool is in the form of a spear (not shown), that is mounted at the bottom of the wireline 75. Those of ordinary skill in the art will appreciate that the wireline 75 is typically run through a lubricator (not shown) at the surface. The spear is configured to land into the plug 200, such as the inner profile 233 at the top 232 of the upper setting sleeve 230. The plug 200 is released with a straight pull, and can then be removed from the well 10 along with the bottom hole assembly 30, 40 relatively fast. The bottom hole assembly 30, 40 can then be changed out, and then re-run into the wellbore 10 on the same wireline. FIG. 6 presents the wellbore 10 of FIG. 5, with the plug tool 200 being retrieved via the wireline 75.

The plug 200 is configured in such a way that a straight pull by the fishing tool will quickly release the plug 200 from the wellbore 10. By pulling the upper setting sleeve 230, the upper setting sleeve 230 is raised relative to the plug body 210. The neck arrangement 252 of the lower setting sleeve 250 causes the lower setting sleeve 250 to be raised with the upper setting sleeve 230. As the lower setting sleeve 250 is raised, the sealing element 270 and the anchoring slip 286 return to their released state.

Figure 3J:
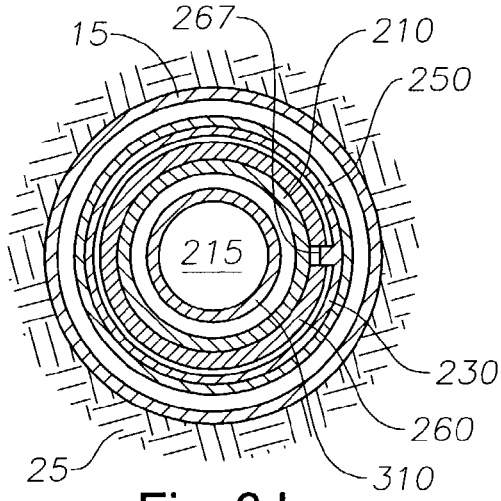
FIG. 3J provides an additional cross-sectional view of the wellbore isolation apparatus of FIG. 2A. The view is taken across line J—J of FIG. 2A. The lugs for latching into the drill pipe are visible in this view.
Figure 3K:
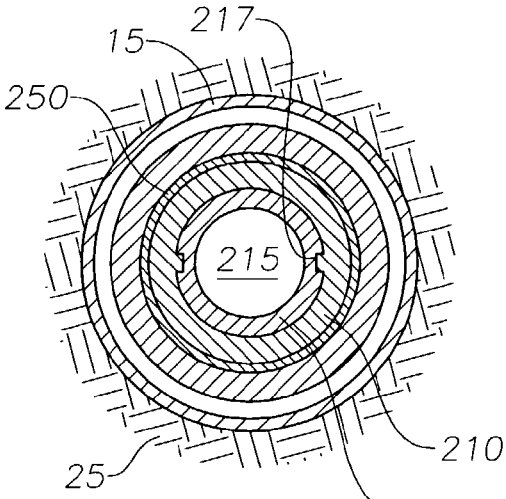
FIG. 3K presents a final cross-sectional view of the wellbore isolation apparatus of FIG. 2A. The view is taken across line K—K of FIG. 2A. Visible in this view, in cross-section, is the split ring.

It is noted that the snap ring 260 is held along the teeth 264 outside the plug body 210. In order to enable the snap ring 260 to be released from the teeth 264 to allow the lower setting sleeve 250 to be raised, a snap ring lug 267 is disposed with the snap ring 260. The snap ring 260 is configured as a C-ring, with the snap ring lug 267 fitting into the split in the C-ring configuration. FIG. 3J demonstrates a cross-sectional view of the bridge plug tool 200, with the view is taken across line J—J of FIG. 2A. Visible in this view, in cross-section, is the split ring 260. Also visible is the lug 267. The lug 267 is trapezoidal shaped so as to urge the split ring 260 apart when the lower setting sleeve 250 and connected lug 267 are moved upward.

After the bottom hole assembly 30, 40 has been changed, it is desirable to run the plug 200 back into the wellbore 10. As noted, the bottom hole assembly 30, 40 can be changed out and re-run into the wellbore 10 on the same wireline. Using technology known in the art, opposing forces are applied as between the upper setting sleeve 230 and the plug body 210 in the bridge plug 200. The sealing element 270 and the anchoring slip 286 are then set against the surrounding casing 15. In this way, the plug 200 is re-set, and the wireline tool is retrieved.

After the plug 200 has been re-set, drill pipe 20 (or other working string) is run back into the wellbore 10. The drill pipe 20 is connected to the setting/releasing tool 300. The setting/releasing tool 300 is landed into the plug 200 in such a way that the upper setting sleeve collet 380 and the plug body collet 386 are landed into the upper setting sleeve profile 233 and the plug body 213 profile, respectively (shown again in FIG. 2A). This also causes the stinger 314 at the lower end of the inner mandrel 310 to force the flapper valve 240 back to its open position. The process for releasing the plug 200 from the surrounding casing 15 can then be initiated.

In operation, a signal is sent to the battery 600 to return the mechanically driven setting piston 420 to its lowered position within the first piston recess 372. The inner-recess channel 422 for the setting system 400 is sealed so that hydraulic pressure within the bore 315 is no longer able to act on the hydraulically driven setting piston 430. Next, a signal is sent to the battery 600 to raise the mechanically driven releasing piston 520. The same signal (or a separate signal) causes the mechanically driven setting piston 420 to be lowered. The mechanically driven releasing piston 520 is then raised within the third piston recess 376 so as to clear the inner recess channel 522 and to expose the fourth piston housing 378 to wellbore pressure within the bore 315 of the mandrel 310. Fluid is then injected into the drill string 20 under pressure. This forces wellbore fluids into the third piston recess 376 below the mechanically driven releasing piston 520. From there, fluids act downward against the hydraulically driven releasing piston 530, and force hydraulic fluids through the hydraulic setting line 615.

During the releasing operation, hydraulic fluid travels through the hydraulic releasing line 615 and enters the releasing chamber 345. As pressure builds, the outer sleeve 320 and attached upper setting sleeve collet 380 move upward. Because the fingers 382 of the upper setting sleeve collet 380 are attached to the upper setting sleeve 230, upward movement of the outer sleeve 320 serves to pull the upper 230 and lower 250 setting sleeves upward. This, in turn, pulls the gauge rings 372 and bonded sealing element 270 upward. As described above, this action causes the sealing element 270 and anchoring slip 286 to be drawn inward and to be released from their sealing and frictional engagements with the surrounding surface casing 15. In this way, the plug 200 is returned to its released state, as shown in FIG. 2A.

Another aspect of the invention relates to sidetrack drilling operations. To this end, an apparatus and method are provided for selectively isolating formation pressures in a lateral wellbore from pressure in the upper primary wellbore. In the various embodiments for such a formation isolation apparatus disclosed herein, the apparatus is integral to the base of a whipstock. However, it is understood that the apparatus embodiments may be separate from the whipstock.

Figure 7A:
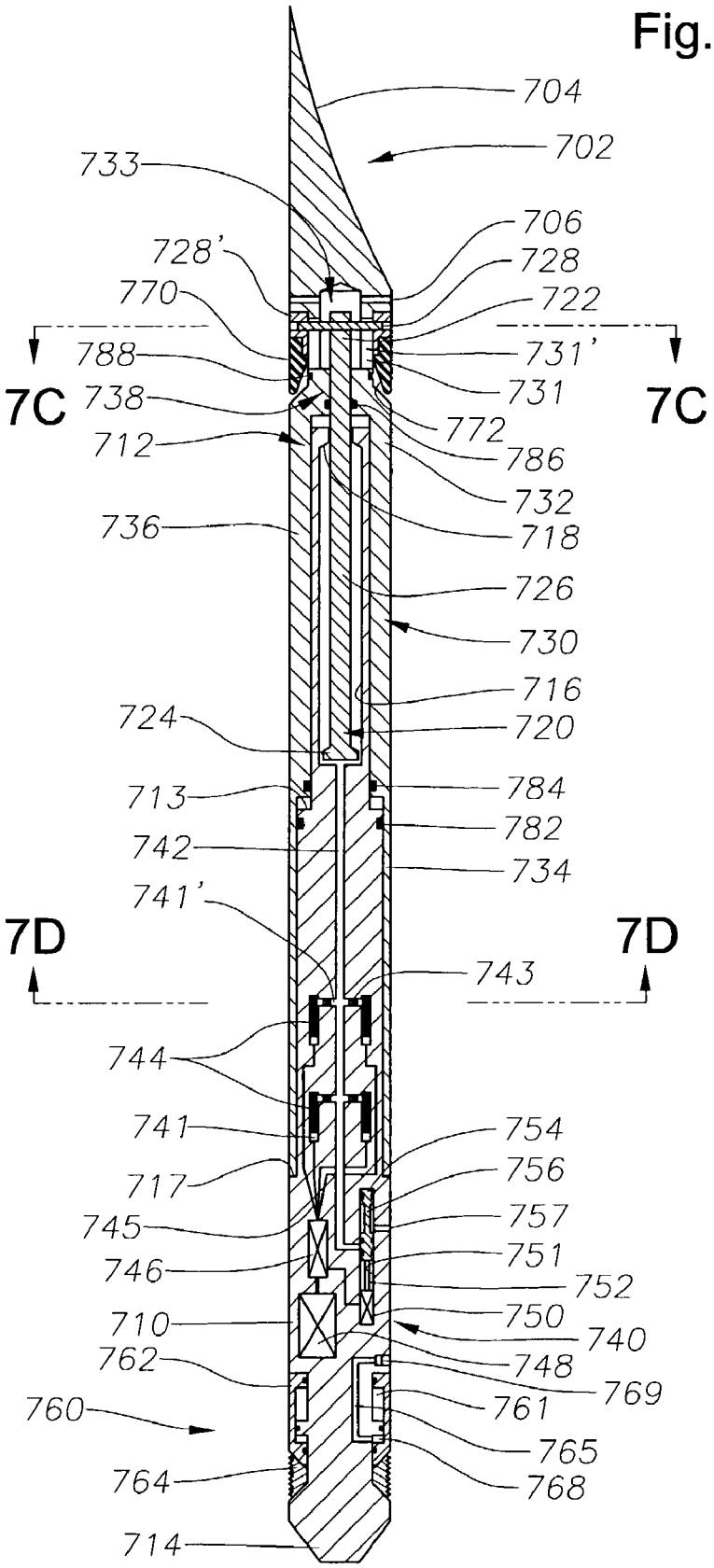
FIG. 7A presents an alternate arrangement for a wellbore isolation apparatus, in cross-section. In this arrangement, the wellbore isolation apparatus is integral to a whipstock. The wellbore isolation apparatus is in its run-in position.

FIG. 7A presents a first arrangement for a wellbore isolation apparatus 700 as would be used during a sidetrack drilling operation. The apparatus 700 is shown in cross-section, in its run-in position. In one aspect, the apparatus 700 defines the base for a whipstock 702. The whipstock 702 includes a concave face 704 used to divert milling and drilling tools from a primary wellbore (shown at 10 in FIG. 7B) into a lateral wellbore (shown at 12 in FIG. 7B). As will be shown, the apparatus 700 is designed to isolate formation pressures while tripping out of the hole 10 during sidetrack drilling.

The wellbore isolation apparatus 700 first comprises an anchor body 710. The anchor body 710 has an upper end 712 and a lower end 714. The anchor body 710 serves as a base that is anchored into a primary wellbore 10 below a window W formed for a lateral wellbore (shown in FIG. 7B). By anchoring the apparatus 700, an upper portion of the apparatus 700, including the whipstock 702, may be urged upward within the primary wellbore 10. A sealing element 770 may then be actuated above the lateral wellbore 12 to seal the primary wellbore 10.

Figure 7B:
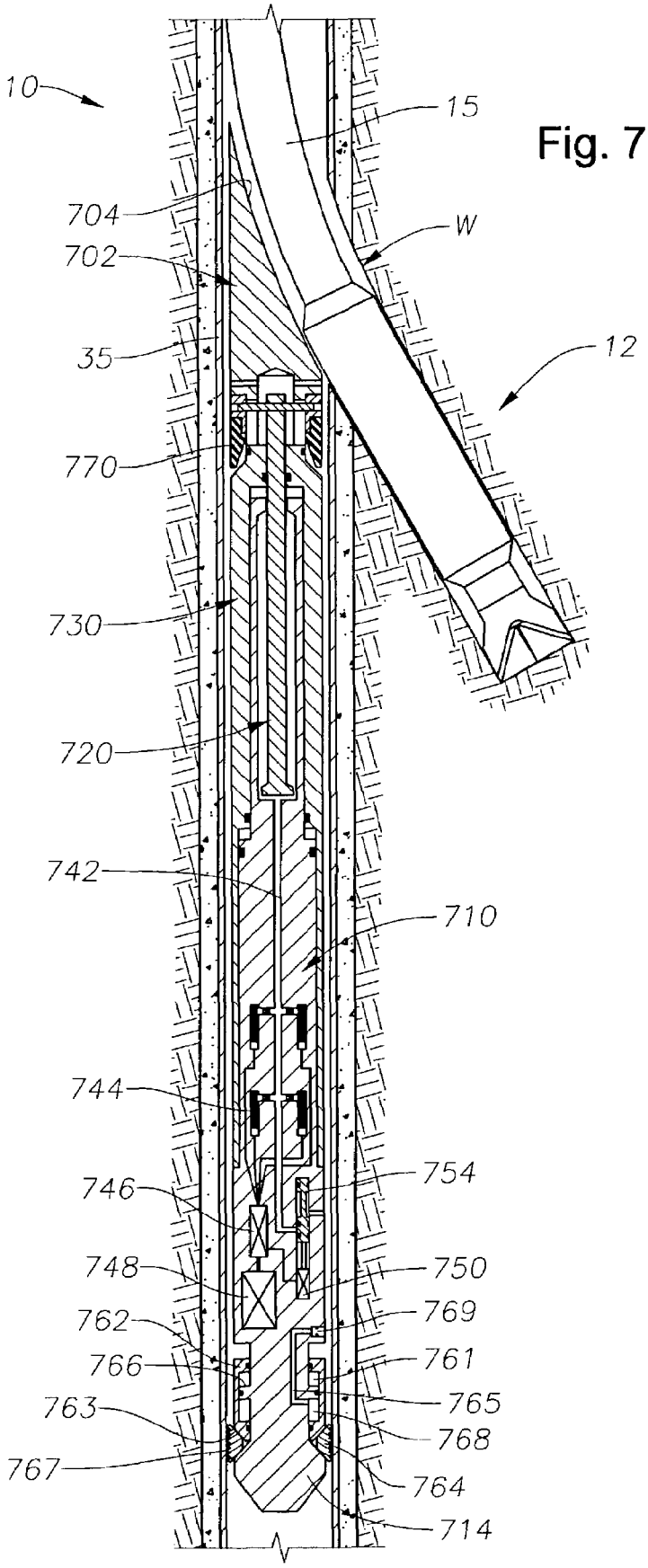
FIG. 7B again presents a cross-sectional view of the wellbore isolation apparatus. Here, the wellbore isolation apparatus is disposed in a wellbore adjacent a lateral wellbore. Sidetrack drilling operations have already formed a window in the primary wellbore, and a lateral wellbore is being formed. In this view, the anchoring system for the whipstock has been actuated in order to set the whipstock in the surrounding casing.
Figure 7C:
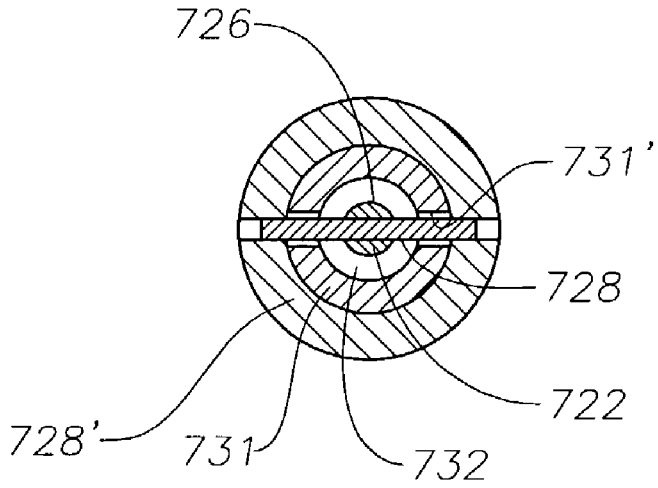
FIG. 7C presents a cross-sectional view of the wellbore isolation apparatus of FIG. 7A, taken across line C—C. The upper end of the piston is visible.

FIG. 7B presents a cross-sectional view of the wellbore isolation apparatus 700 of FIG. 7A. The wellbore isolation apparatus 700 is disposed in a primary wellbore 10 adjacent a lateral wellbore 12. Sidetrack drilling operations have already formed a window W in the primary wellbore 10. A lateral wellbore 12 is seen being formed off of the primary wellbore 10. In the view of FIG. 7B, the body 710 has been anchored into the primary wellbore 10. In this arrangement, an anchoring system 760 that is integral to the anchor body 710 is employed. Features of the integral anchoring system 760 will be described below. While an integral anchoring system 760 is shown, it is understood that a separate anchor (not shown) may be utilized instead. In such an arrangement, the bottom end 714 of the anchor body 710 would be landed into an anchor, such as a packer having a slip mechanism. The anchor (not shown) would preferably have a key or other orientation indicating member. The landed body's 710 orientation would be checked by running a tool, such as a gyroscope indicator or measuring-while-drilling device into the wellbore 10.

As noted, the anchor body 710 of the formation isolation apparatus 700 has a top end 712 and a bottom end 714. The top end 712 defines a tubular section having a recess 716 formed therein. As will be described further below, the recess 716 slideably receives an elongated piston 720. A piston channel 718 is provided in the top end 712 of the anchor body 710 to guide the piston 720 as it extends upward from the piston channel 718.

In the arrangement of FIGS. 7A and 7B, a pair of shoulders 713, 717 are formed along the outer diameter of the anchor body 710. An upper shoulder 713 and a lower shoulder 717 are provided. As will be shown below, the shoulders 713, 717 serve to enable a sleeve 730 to be received over the anchor body 710.

The formation isolation apparatus 700 next comprises a piston 720. The piston 720 defines an elongated shaft 726 preferably fabricated from a metal alloy. The piston 720 has an upper end 722 and a lower end 724. The upper end 722 resides above the piston channel 718 of the anchor body 710, while the lower end 724 sealingly resides within the piston recess 716 of the body 710. The shaft 726 of the piston 720 is dimensioned to slideably move within the piston channel 718. The lower end 724 is configured to have an outer diameter larger than the piston channel 718. In this way, the stroke of the piston 720 is limited so that the piston 720 cannot be extruded completely out of the piston recess 716.

The upper end 722 of the piston 720 includes one or more arms 728. The arms 728 extend more or less perpendicularly away from the piston shaft 726. In one arrangement, the arms 728 include a radial "halo" member 728' (shown in FIG. 7B). As will be shown more fully below, the arms 728 are disposed below the concave face 704 of the whipstock 702 in order to provide support as the whipstock 702 is raised in the wellbore 10.

FIG. 7B presents a cross-sectional view of the wellbore isolation apparatus of FIG. 7A, taken across line B—B. The top of the piston 720 is visible, including the central shaft 726 and the arms 728. The halo portion 728' of the arms 728 is more fully seen. The halo portion 728' is disposed around a slotted support member 731 that extends below the whipstock 702. Slots 731' can be seen in the slotted support member 731 in the view of FIG. 7B.

Returning to FIG. 7A, the formation isolation apparatus 700 next comprises a sleeve 730. In one aspect, the sleeve 730 defines an elongated body having an upper tubular portion 732, a lower tubular portion 734, and an intermediate tubular portion 736. The upper tubular portion 732 has a bore therein that serves as a piston channel 738. The piston channel 738 slideably receives the piston 720 as it is urged upward from the piston recess 716 of the anchor body 710. An O-ring (or other seal) 786 seals the interface between the piston channel 738 of the upper tubular portion 732 and the piston shaft 726.

The intermediate tubular portion 736 of the sleeve 730 is configured to receive the upper end 712 of the anchor body 710. In the arrangement of FIG. 7A, the lower end of the intermediate tubular portion 736 shoulders out against the upper shoulder 713 of the anchor body 710. An O-ring (or other seal) 784 seals the interface between the intermediate tubular portion 736 and the anchor body 710.

The lower tubular portion 734 of the sleeve 730 is configured to receive an intermediate portion of the anchor body 710. In the arrangement of FIG. 7A, the lower end of the lower tubular portion 736 shoulders out against the lower body shoulder 717 of the anchor body 710. An O-ring (or other seal) 782 seals the interface between the lower tubular portion 734 and the anchor body 710.

The formation isolation apparatus 700 next comprises a sealing element 770. The sealing element 770 is an elastomeric (or other pliable) body radially disposed around the slotted support member 731. In the arrangement of FIG. 7A, the sealing element 770 is also disposed below the halo portion 728' of the support arms 728. The sealing element 770 includes inner lips 772 that are beveled in order to conform to the dimensions of a beveled outer diameter of the upper end 732 of the sleeve 730. As will be described below, when the apparatus 700 is actuated, the sealing element 770 is compressed between the arms 728' of the piston 720 and the upper end 732 of the sleeve 730, causing the sealing element 770 to be extruded outward into sealed engagement with a surrounding casing string, such as liner 35 (seen in FIG. 7E). A seal 788 is additionally provided around the upper sleeve 732 to enhance the seal between the sealing element 770 and an outer shoulder 733 of the sleeve 730.

The formation isolation apparatus 700 of FIG. 7A finally comprises a sealing element actuation system 740. The sealing element actuation system 740 serves to urge the sleeve 730 and the piston 720 upward relative to the anchor body 710. As noted above, actuation of the apparatus 700 also causes the sealing element 770 to be extruded outward into sealed engagement with a surrounding casing string.

In the arrangement of apparatus 700, the sealing element actuation system 740 first comprises motor 750. The motor 750 is disposed within a motor recess 751 in the anchor body 710. The motor 750 is connected to a mechanically driven plug 754. The plug 754 includes a portion 756 having a reduced diameter. The plug 754 resides within the motor recess 751, and is translated by the motor 750. In the arrangement of FIG. 7A, a drive screw 752 connects the plug 754 to the motor 750. Rotation of the drive screw 752 by the motor 750 causes the plug 754 to be translated along the longitudinal axis of the motor recess 751. In this respect, the plug 754 is attached to a nut (not shown) that travels along threads in the drive screw 752.

The sealing element actuation system 740 also includes a power source 748. The power source 748 provides power for operating the motor 750. In the preferred arrangement, the power source 748 is a battery disposed within a recess of the anchor body 710. The power source 748 is in electrical communication with electronics. The electronics are shown schematically in FIG. 7A at 746. The electronics 746 are configured to receive communication from the surface in order to selectively actuate the motor 750. In one aspect, the electronics 746 respond to acoustic signals delivered downhole, such as by a selected rotational sequence of the drill string.

The sealing element actuation system 740 of FIG. 7A is fluid actuated. A fluid channel 742 is provided within the body 710 of the apparatus 700 for receiving fluid under pressure. At one end, the fluid channel 742 is in fluid communication with the piston recess 716 below the piston 720. At an opposite end, the fluid channel 742 is in fluid communication with the motor recess 751 adjacent the plug 754.

The source of fluid pressure for the sealing element actuation system 740 of FIG. 7A is a series of power charges 744. The power charges 744 are disposed within individual recesses 741 within the anchor body 710. In order to actuate fluid pressure in the actuation system 740, one or more of the power charges 744 is ignited. Ignition occurs in response to an electrical current generated by the battery 748. Each power charge 744 defines a plastic (or other) tube filled with a chemical. The power charge is commonly referred to as either a "chemical gas generator" or a pyrotechnic gas generator." The electrical current causes the chemical within the tube to ignite, thereby releasing a gas. Alternatively, the current may ignite a separate igniter (not shown), which then ignites the power charge 744. Power charges 744 typically are available having varying burn rates and pressures. An example of a commercially available power charge is the Baker product no. 437-64.

Each power charge recess 741 is in electrical communication with the electronics 746 and battery 748. Each recess also includes a channel arm 741' that extends away from the recess 741. Each arm 741' includes a check valve 743. The check valves 743 ensure that gas is released from the respective power charge recesses 741 and into the fluid channel 742.

Figure 7D:
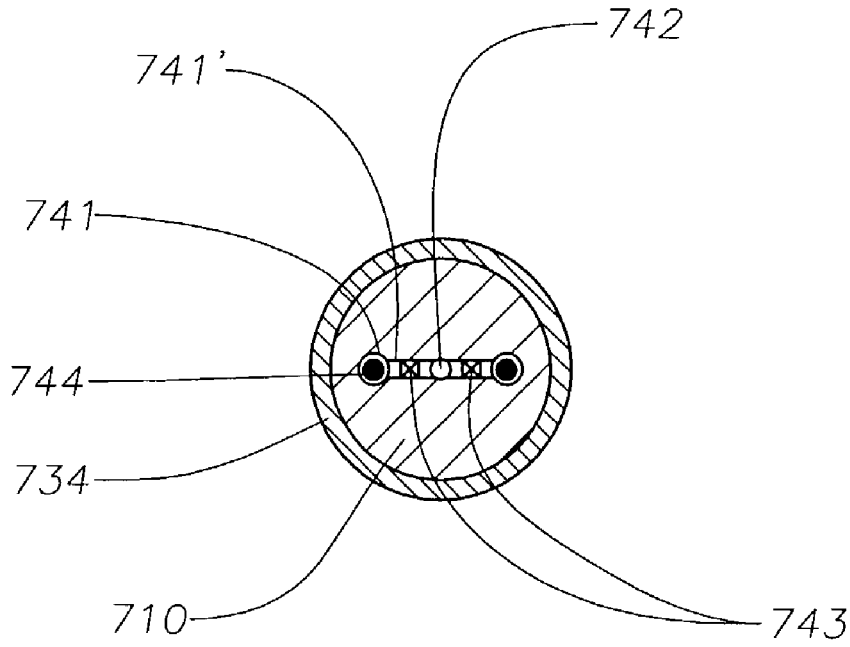
FIG. 7D presents a cross-sectional view of the wellbore isolation apparatus of FIG. 7A, taken across line D—D. The power charges are visible.

FIG. 7D presents a cross-sectional view of the wellbore isolation apparatus of FIG. 7A. The view is taken across line D—D of FIG. 7A. In this view, the power charges 744 are visible. Also visible are channel arms 741', and valves 743 within the channel arms 741'. The apparatus is disposed within a wellbore 10.

In operation, the formation isolation apparatus 700 of FIG. 7A is run into the primary wellbore 10 on a working string 15. The formation isolation apparatus 700 again is integral to the whipstock 702 in one arrangement. In such an arrangement, the whipstock 702 is typically lowered into the primary wellbore 10, and is connected to the lower end of the working string by a releasable connection. In one aspect, a milling bit (not shown) is also connected to the lower end of the working string. Details concerning the running in and operation of a whipstock during sidetrack drilling operations are provided in U.S. patent application Ser. No. 10/079,139 entitled "System for Milling a Window and Drilling a Sidetrack Wellbore." This application, whose named inventors are Roberts and Haugen, is incorporated herein in its entirety, by reference.

Once the whipstock 702 and integral formation isolation apparatus 700 have been installed at the desired depth, the whipstock 702 and apparatus are anchored in the primary wellbore 10. As noted, the lower end 714 of the anchor body 710 may be landed into a separate anchoring tool (not shown). However, in the arrangement shown in FIG. 7A, an optional integral anchoring system 760 is provided.

FIG. 7B provides a cross-sectional view of the apparatus 700 of FIG. 7A. In this view, the apparatus 700 has been run into a wellbore 10 as part of sidetrack drilling operations. Visible in FIG. 7B is a liner string 35 cemented into the primary wellbore 10. A window W has been formed in the liner 35, and a lateral wellbore 12 is being formed.

It can also be seen in FIG. 7B that the anchoring system 760 has been activated, thereby anchoring the apparatus 700 and whipstock 702 in the primary wellbore 10. The anchoring system 760 first comprises a slip 764. The slip 764 is disposed within a recess along the lower end 714 of the anchor body 710. An outer surface of the slip 764 has teeth 767 for frictionally engaging the surrounding casing when the slip 764 is actuated. The slip 764 is urged outward via a cone member 762. The cone 762 defines a tubular body that sealingly encompasses a shoulder 766 in the anchor body 710 in order to define an upper (releasing) chamber 761 and a lower (setting) chamber 768. The cone includes a lower beveled edge 763 that rides under a corresponding beveled edge of the slip 764.

The anchoring system 760 of FIG. 7A is hydraulically actuated. Actuation takes place after the apparatus 700 has been run into the wellbore 10, with the anchoring system 760 in its released state. The released state of the anchoring system 760 is shown in FIG. 7A. In this state, the beveled edge 763 of the cone 762 has not been driven under the slip 764. Next, hydraulic fluid is injected under pressure into the wellbore 10 from the surface. A rupture disc 769 is provided along the lower anchor body 714. At a designated pressure, the rupture disc 769 is broken. Hydraulic fluid then enters an anchor setting channel 765. From there, fluid flows under pressure into the setting chamber 768, causing the cone 762 to ride under the slip 764. This, in turn, extrudes the teeth 767 of the slips 764 into frictional engagement with the surrounding casing string 35. The apparatus 700 is then anchored in the primary wellbore 10.

Figure 7E:
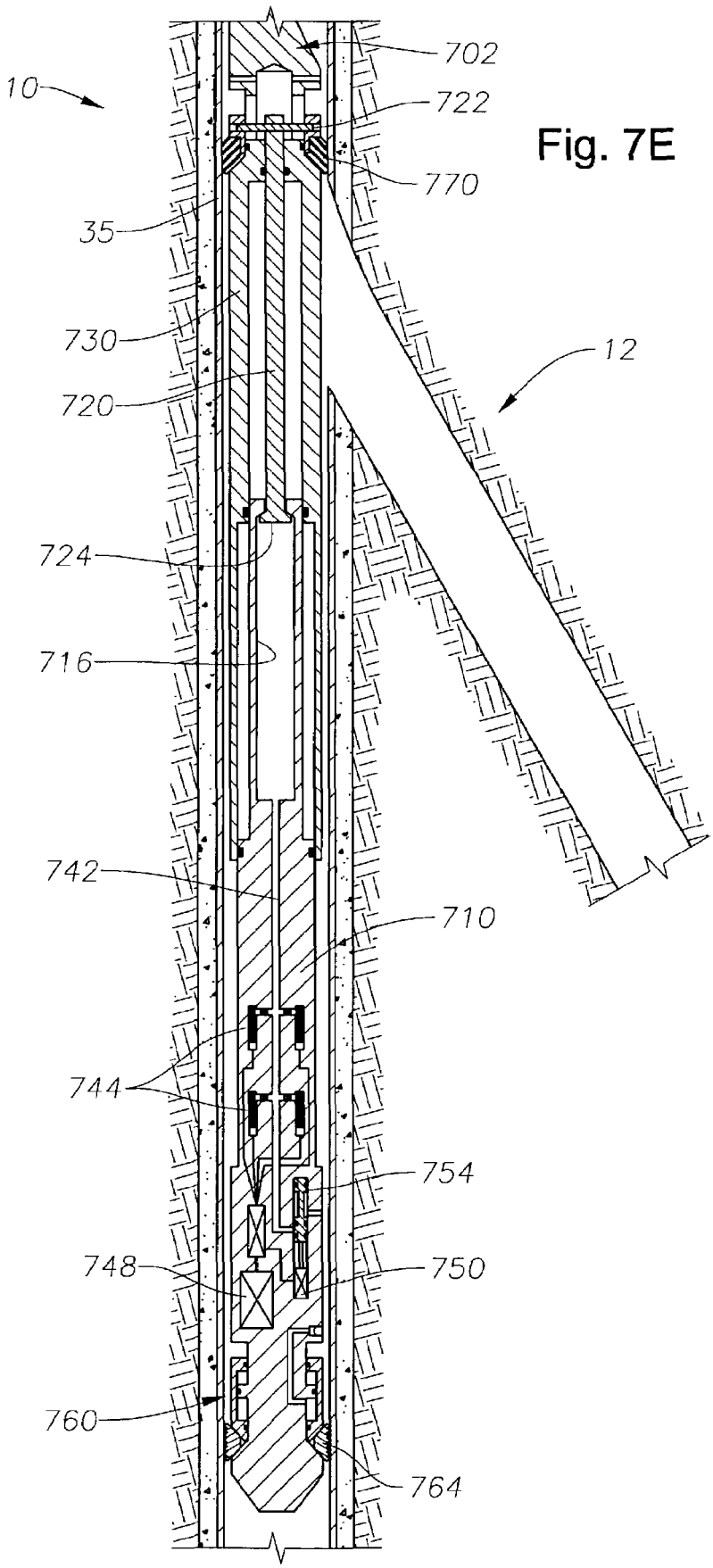
FIG. 7E presents a cross-sectional view of the wellbore isolation apparatus of FIG. 7B. Here, the wellbore isolation apparatus has been actuated so as to raise the sealing element above the depth of the lateral wellbore, and to set the sealing element in the surrounding casing.

FIG. 7E presents a cross-sectional view of the wellbore isolation apparatus 700 within the wellbore 10 of FIG. 7B. Here, the wellbore isolation apparatus 700 has been anchored within the primary wellbore 10. It can be seen that the anchoring system 760 has been actuated in order to force the teeth 767 of the slips 764 into frictional engagement with the surrounding casing string 35. The drill string has been removed, leaving the apparatus 700 within the wellbore 10 set below the lateral wellbore 12.

After the anchor body 710 has been set, the sealing element actuation system 740 may be actuated. In FIG. 7E, it can be seen that the sealing element actuation system 740 has been actuated so as to raise the sealing element 770 above the depth of the lateral wellbore 12. This is first accomplished by igniting one or more of the power charges 744. An acoustic or other signal is sent to the electronics 746. The electronics 746 then direct the battery 748 to send an electrical charge to one of power charges 744 in order to ignite the power charge 744. The power charge 744 then generates fluid under pressure from the power charge recess 741 and into the fluid channel 742.

Upon actuation, the electronics 746 first send a signal to the motor 750. The motor 750 drives the mechanically driven plug 754 upward in the motor recess 751. This serves to seal the lower outlet of the fluid channel 742 so that it is no longer in fluid communication with the pressure vent 757. This forces fluid under pressure to flow through the fluid channel 742, into the recess 716, and to act against the sleeve 730.

As pressure builds in the fluid channel 742, it flows into the piston recess 716 of the body 710. From there, fluid travels through the piston channel 718 of the body 710, and fills the space between the outer diameter of the upper anchor body 712 and the inner diameter of the intermediate tubular portion 736 of the sleeve 730. Seals 786 and 784 described above serve to hold pressure within this annular space. Fluid pressure within the described annular space urges the sleeve 730 upward relative to the anchor body 710. Because the arms 728 of the piston 720, including the radial "halo" member 728', are connected to the sleeve 730 via the slotted support structure 731, the piston 720 is pulled upward during actuation of the sealing element actuation system 740. The concave face portion 704 of the whipstock 702 is also moved upward in the wellbore 10.

In accordance with the present invention, actuation of the sealing element actuation system 740 also serves to actuate the sealing element 770 into sealing engagement with the surrounding casing 20. To achieve this function, the length of the piston's stroke is less than the length of the sleeve's stroke. Thus, as the piston 730 is pulled upward, the lower end 724 of the piston 720 shoulders out below the piston channel 738 of the sleeve 730. However, because the arms 728 of the piston 720 reside in slots of the support structure 731, the sleeve 730 is able to continue to stroke upward even after the piston 720 has stroked out. The continued movement of the sleeve 730 causes the sealing element 770 to become compressed between the radial "halo" member 728' of the arms 728, and the outside diameter of the upper tubular portion 732 of the sleeve 730. Ultimately, and as shown in FIG. 7E, the sealing element 770 is extruded into sealing engagement with the surrounding casing 35 at a depth above the lateral wellbore 12. The formation pressures within the lateral wellbore 12 are thereby isolated.

At some point, the operator will want to come back into the wellbore with new operating equipment. In order to access the lateral wellbore 12 for further drilling or completion operations, the formation isolation apparatus 700 will need to be unsealed and deactuated. In the present arrangement, the operator sends a new signal to the electronics 746, instructing the motor 750 to reverse, thereby driving the plug 754 downwards in the motor recess 751. As the plug 754 is lowered, the reduced diameter portion 756 of the plug 754 is placed adjacent the fluid channel 742, allowing fluid to enter the motor recess 751. A pressure vent 757 is formed in the motor recess 751, allowing the fluid to exit into the wellbore 10. In this manner, the fluid pressure applied to the sleeve 730 to extend the piston 720 and to actuate the sealing element 770 is discharged.

To further aid in the release of the sealing element 770 from the surrounding casing, an optional sealing element vent 706 is disposed above the slotted support structure 731. The sealing element vent 706 allows wellbore pressure to act against the inner lips 772 of the sealing element 770, aiding release of the sealing element 770 from the outer shoulder 733.

Figure 8A:
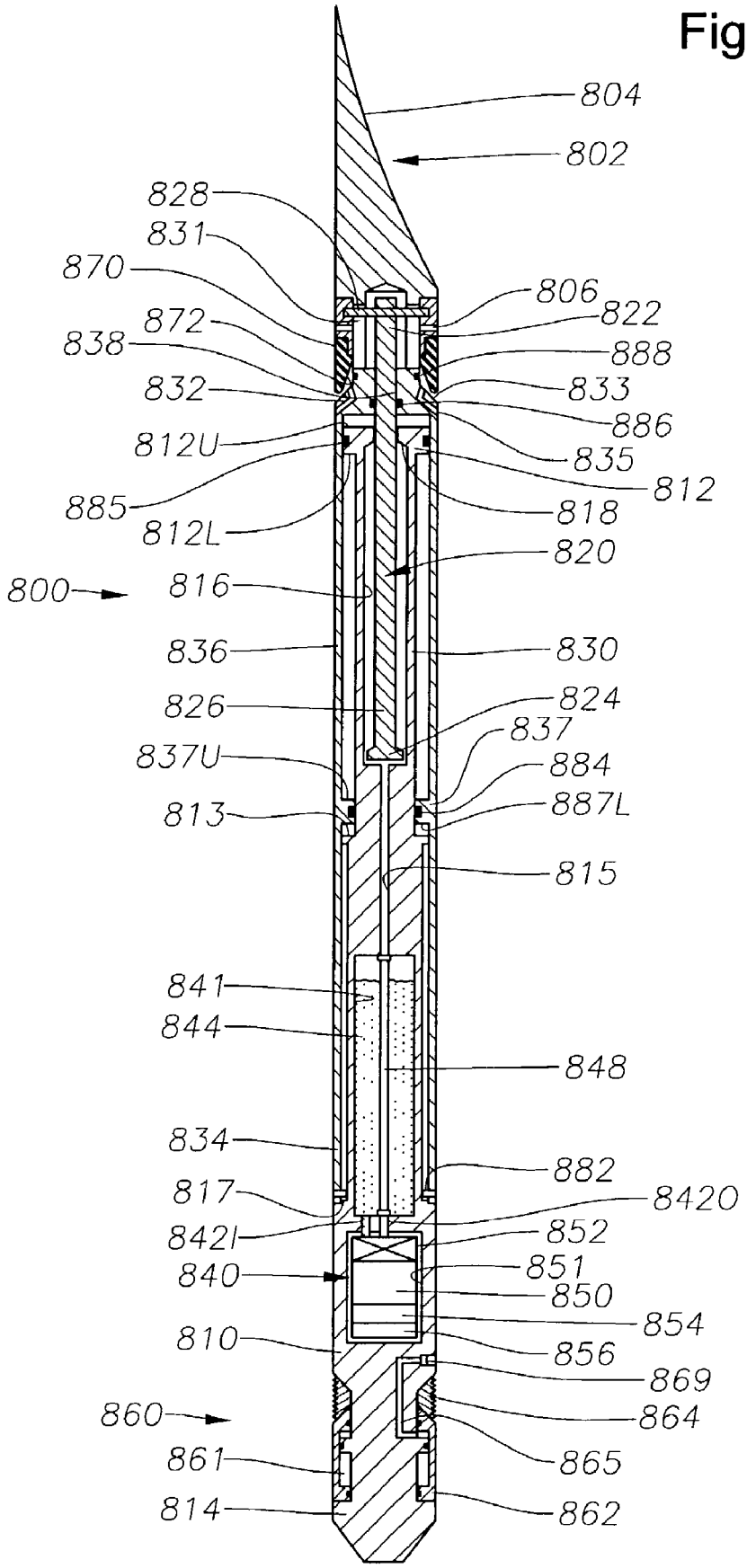
FIG. 8A presents another arrangement for a wellbore isolation apparatus that is integral to a whipstock. The apparatus is again shown in cross-section. The wellbore isolation apparatus is in its run-in position.

Two additional embodiments for a wellbore isolation apparatus as would be used during a sidetrack drilling operation are disclosed herein. FIG. 8A presents a second arrangement for a wellbore isolation apparatus 800. This second arrangement is also integral to a whipstock 802. The apparatus 800 is shown in cross-section in FIG. 8A, in its run-in position. The whipstock 802 again includes a concave face 804 used to divert milling and drilling tools from a primary wellbore (shown at 10 in FIG. 8B) into a lateral wellbore (shown at 12 in FIG. 8B).

As with the wellbore isolation apparatus of FIGS. 7A–E, the wellbore isolation apparatus of FIG. 8A 800 first comprises an anchor body 810. The anchor body 810 has an upper end 812 and a lower end 814. The anchor body 810 serves as a base that is anchored into a primary wellbore 10 below a window W formed for a lateral wellbore. By anchoring the apparatus 800, an upper portion of the apparatus 800, including the whipstock 802, may again be urged upward within the primary wellbore 10. A sealing element 870 is then actuated above the lateral wellbore 12 to seal the primary wellbore 10.

The formation isolation apparatus 800 next comprises a piston 820. The piston 820 defines an elongated tool preferably fabricated from a metal alloy. The piston 820 has an upper end 822, a lower end 824, and an intermediate shaft 826. The upper end 822 resides above the piston channel 818 of the anchor body 810, while the lower end 824 sealingly resides within the recess 816 of the body 810. The shaft 826 of the piston 820 is dimensioned to slideably move within the piston channel 818. The lower end 824 is configured to have an outer diameter larger than the piston channel 818. In this way, the stroke of the piston 820 is limited so that the piston 820 cannot be extruded completely out of the piston recess 816.

The upper end 822 of the piston 820 is configured as the upper end 722 of the piston 720 in FIG. 7A. In this respect, the upper end 822 also includes one or more arms 828 and a radial "halo" member 828'. The halo member 828' is not shown, but is in accordance with the halo member 728' shown and described in FIG. 7C. The arms 828 are again disposed below the concave face 804 of the whipstock 802 in order to provide support as the whipstock 802 is raised in the wellbore 10. A slotted support member 831 that extends below the whipstock 802 is also again provided. The slotted support member 831 includes slots 831' that are not seen, but are also in accordance with the slots 731' shown in the view of FIG. 7C.

Returning to FIG. 8A, the formation isolation apparatus 800 next comprises a sleeve 830. In one aspect, the sleeve 830 defines an elongated body having an upper tubular portion 832, a lower tubular portion 834, and an intermediate tubular portion 836. The upper tubular portion 832 has a bore therein that serves as a piston channel 838. The piston channel 838 slideably receives the piston 820 as it is urged upward from the recess 816 of the anchor body 810. An O-ring (or other seal) 886 seals the interface between the piston channel 838 of the upper tubular portion 832 and the piston shaft 826.

Figure 8B:
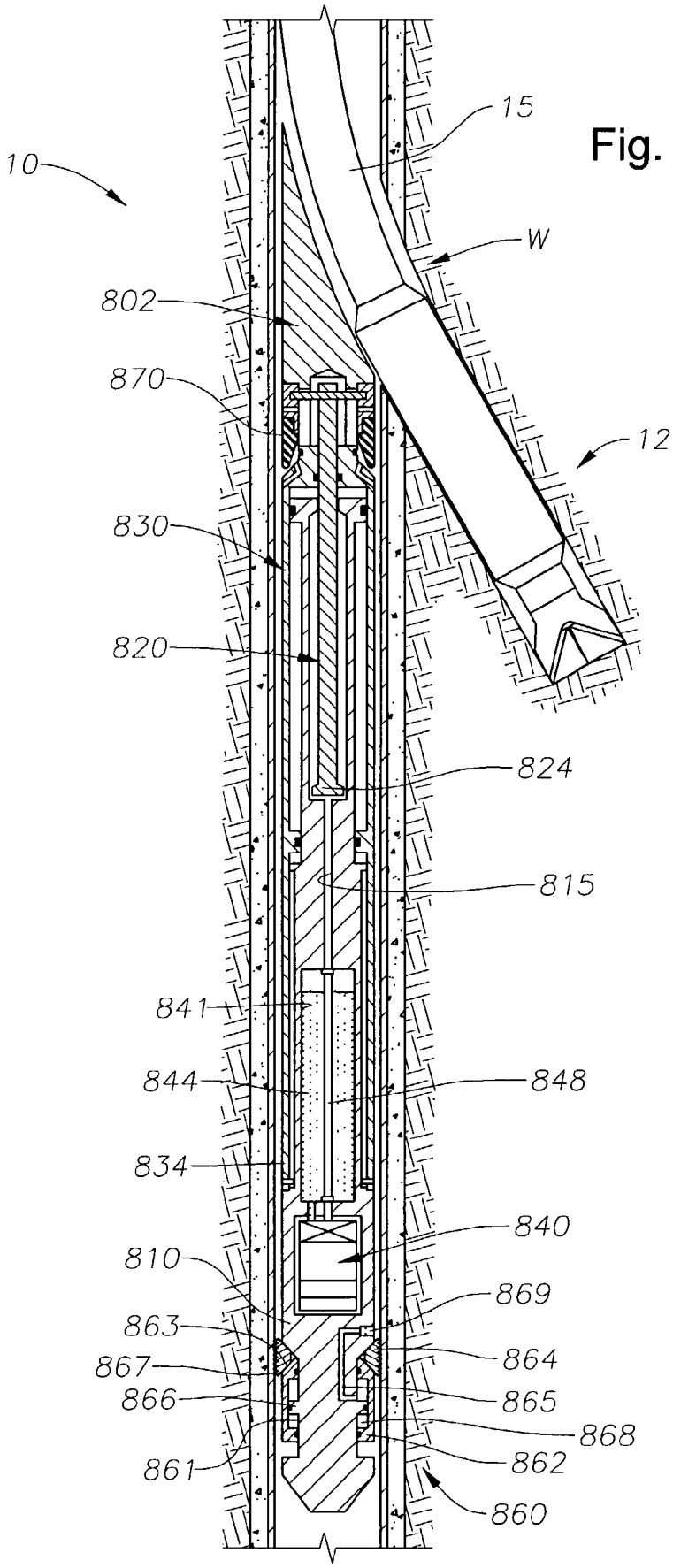
FIG. 8B presents a cross-sectional view of the wellbore isolation apparatus of FIG. 8A. The wellbore isolation apparatus is disposed in a wellbore adjacent a lateral wellbore. Sidetrack drilling operations have already formed a window in the primary wellbore, and a lateral wellbore is being formed. In this view, the anchoring system for the whipstock has been actuated in order to set the whipstock in the surrounding casing.

The sleeve 830 is configured to have a shoulder 837 between the intermediate tubular portion 836 and the lower tubular portion 834. The shoulder 837 forms a top surface 837U and a bottom surface 837L. The bottom surface 837L FIG. 8B presents a cross-sectional view of the wellbore isolation apparatus 800 of FIG. 8A. The wellbore isolation apparatus 800 is disposed in a primary wellbore 10 adjacent a lateral wellbore 12. Sidetrack drilling operations have already formed a window W in the primary wellbore 10. A lateral wellbore 12 is seen being formed off of the primary wellbore 10. In the view of FIG. 8B, the body 810 has been anchored into the primary wellbore 10. In this arrangement, an anchoring system 860 that is integral to the anchor body 710 is employed. Features of the integral anchoring system 760 will be described below. While an integral anchoring system 760 is shown, it is again understood that a separate anchor (not shown) may be utilized instead.

As noted, the anchor body 810 of the formation isolation apparatus 800 has a top end 812 and a bottom end 814. The top end 812 defines a tubular section having a recess 816 formed therein. As will be described further below, the recess 816 slideably receives an elongated piston 820. A piston channel 818 is provided in the top end 812 of the anchor body 810 to guide the piston 820 as it extends upward from the piston channel 818. The top end 812 of the body 810 includes a shoulder forming top 812U and bottom 812L radial surfaces around the piston channel 818.

A fluid channel 815 is also formed in the body 810. The fluid channel 815 is generally oriented along the longitudinal axis of the anchor body 810. The fluid channel 815 has a top end in fluid communication with the piston recess 816, and a bottom end in fluid communication with a fluid outlet tube 848. As will be described later, the fluid outlet tube 848 serves to deliver fluid under pressure from a fluid reservoir 841 to the piston recess 816.

In the arrangement of FIGS. 8A and 8B, a pair of shoulders 813, 817 are formed along the outer diameter of the anchor body 810. An intermediate shoulder 813 and a lower shoulder 817 are provided. As will be shown below, the shoulders 813, 817 serve to enable a sleeve 830 to be received over the anchor body 810. shoulders out against the intermediate shoulder 813 of the anchor body 810. An O-ring (or other seal) 884 seals the interface between the shoulder 837 and the anchor body 810.

The lower tubular portion 834 of the sleeve 830 is configured to receive an intermediate portion of the anchor body 810. In the arrangement of FIG. 8A, the lower end of the lower tubular portion 836 shoulders out against the lower body shoulder 817 of the anchor body 810. An O-ring (or other seal) 882 seals the interface between the lower tubular portion 834 and the anchor body 810.

The formation isolation apparatus 800 next comprises a sealing element 870. The sealing element 870 is dimensioned in accordance with sealing element 770 described above, and includes inner lips 872. Further, sealing element 870 is disposed along the slotted support structure 831 and halo member 828' in the same way as sealing element 770. As with sealing element 770, sealing element 870 is actuated when the sealing element 870 is compressed between the arms 828 of the piston 820, and the upper end 832 of the sleeve 830, causing the sealing element 870 to be extruded outward into sealed engagement with a surrounding casing string, such as liner 35. A seal 888 is additionally provided around the outer diameter of the upper sleeve 832 to enhance the seal between the sealing element 870 and an outer shoulder 833 along the sleeve 830.

The formation isolation apparatus 800 of FIG. 8A finally comprises a sealing element actuation system 840. The sealing element actuation system 840 serves to urge the sleeve 830 and the piston 820 upward relative to the anchor body 810. As noted above, actuation of the apparatus 800 also causes the sealing element 870 to be extruded outward into sealed engagement with a surrounding casing string 35.

The sealing element actuation system 840 first comprises a motor that defines a pump 850. The pump 850 is disposed within a pump recess 851 in the anchor body 810. The pump 850 cycles fluid in and out of a fluid reservoir 841 placed within a fluid reservoir recess 841. To aid in the circulation of fluid, a fluid inlet channel 842I is provided. The fluid inlet channel 842I places the fluid reservoir 841 in fluid communication with the pump 850. More specifically, fluid is drawn into the pump 850 from the fluid reservoir 844 through the fluid inlet channel 842I. The pump 850 includes a valve apparatus (shown schematically at 852). When fluid is drawn into the pump 850 from the fluid reservoir 844, it is retained by the valve 852. Fluid is then delivered to a fluid outlet channel 842O, and then to the fluid outlet tube 848.

The sealing element actuation system 840 also includes a power source 854. The power source 854 provides power for operating the pump 850. In the preferred arrangement, the power source 854 is a battery disposed within a recess of the anchor body 810. The power source 854 is in electrical communication with electronics. The electronics are shown schematically in FIG. 8A at 856. The electronics 856 are configured to receive communication from the surface in order to selectively actuate the pump 850. As with electronics 746 from FIG. 7A, in one aspect, the electronics 856 in FIG. 8A respond to acoustic signals delivered downhole, such as by a selected rotational sequence of the drill string (not shown).

In operation, the formation isolation apparatus 800 of FIG. 8A is run into the primary wellbore 10 on a working string. The process for setting the apparatus 800 and the integral whipstock 802 is as described above in connection with FIG. 7E. Further, the anchoring system 860 for the formation isolation apparatus 800 of FIG. 8A is generally in accordance with the anchoring system 760 described above, and need not be described again. Parts 861, 862, 863, 864, 865, 866, 867, 868 and 869 from FIG. 8A correspond to parts 761, 762, 763, 764, 765, 767, 766, 767, 768 and 769 from FIG. 7A. However, it is again understood that a separate anchoring tool (not shown) may be utilized. The actuated anchoring system 860 is shown in FIG. 8B.

Figure 8C:
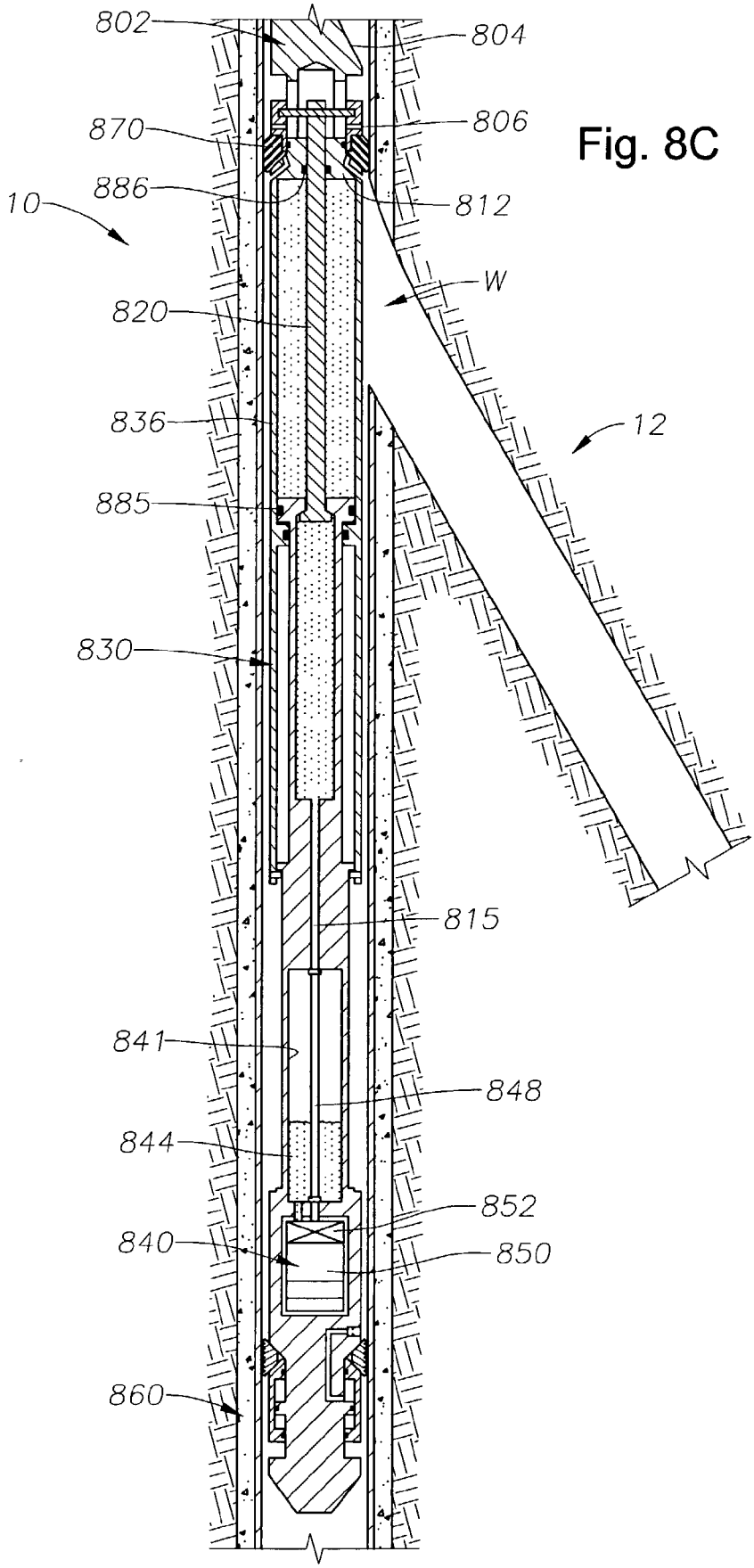
FIG. 8C presents a cross-sectional view of the wellbore isolation apparatus of FIG. 8B. Here, the wellbore isolation apparatus has been actuated so as to raise the sealing element above the depth of the lateral wellbore, and to set the sealing element in the surrounding casing.

FIG. 8C presents a cross-sectional view of the wellbore isolation apparatus 800 within the wellbore 10 of FIG. 8B. Here, the wellbore isolation apparatus 800 has again been anchored within the primary wellbore 10 using the anchoring system 860. In the arrangement of FIG. 8C, this is accomplished by applying hydraulic pressure into the wellbore 10 from the surface. This procedure is in accordance with the procedure described more fully in connection with FIG. 7E, above.

After the anchor body 810 has been set, the sealing element actuation system 840 may be actuated. In FIG. 8C, it can be seen that the sealing element actuation system 840 has been actuated so as to raise the sealing element 870 above the depth of the lateral wellbore 12. To accomplish this, the electronics receive a signal to turn on the pump 850. The pump 850 begins to pump fluid from the fluid reservoir 841, through the valve apparatus 852, and through the fluid outlet tube 848. From there, fluid is delivered under pressure into the recess 816 around the piston 820.

As pressure builds in the recess 816, fluid travels through the piston channel 818 of the body 810 and fills the space between the inner surface of the upper anchor body 812 and the inner diameter of the intermediate tubular portion 836 of the sleeve 830. As noted, seal 886 seals the interface between the piston channel 838 of the upper tubular portion 832 and the piston shaft 826. In addition, seal 885 seals the interface between the outer diameter of the upper anchor body 812 and the inner diameter of the intermediate tubular portion 836 of the sleeve 830. These seals 886, 885 serve to hold pressure against the sleeve 830, urging the sleeve 830 upward relative to the anchor body 810. Because the arms 828 of the piston 820, including the radial "halo" member 828', are connected to the sleeve 830 via the slotted support structure 831, the piston 820 is pulled upward during actuation of the sealing element actuation system 840. The concave face portion 804 of the whipstock 802 is also moved upward above the slotted support structure 831.

In accordance with the present invention, actuation of the sealing element actuation system 840 serves not only to raise the sleeve 830 and connected sealing element 870, but also to actuate the sealing element 870 into sealing engagement with the surrounding casing 35. This function is accomplished in the same manner as described for sealing element 770 in connection with FIG. 7E, and will not be repeated herein for FIG. 8C. Ultimately, and as shown in FIG. 8C, the sealing element 870 is extruded into sealing engagement with the surrounding casing at a depth above the lateral wellbore 12. The formation pressures within the lateral wellbore 12 are thereby isolated.

At some point, the operator will want to come back into the wellbore with new operating equipment. In order to access the lateral wellbore 12 for further drilling or completion operations, the formation isolation apparatus 800 will need to be unsealed and deactuated. In the present arrangement, the operator sends a new signal to the electronics 856, instructing the pump 850 to reverse flow, thereby pumping fluid from the fluid outlet tube 848, through the fluid outlet channel 842O, back through the valve apparatus 852, through the fluid inlet channel 842I, and back into the fluid reservoir 841.

To further aid in the release of the sealing element 870 from the surrounding casing, an optional sealing element vent 806 is disposed in the arms 828' adjacent the slotted support structure 831. The sealing element vent 806 allows wellbore pressure to act through the slots 831' and against the inner lips 872 of the sealing element 870, aiding release of the sealing element 870 from an outer shoulder 833 in the upper sleeve 832. In addition, bypass holes 835 are optionally formed in the upper shoulder 833 in the upper sleeve 832 of the sleeve 830, further allowing fluid pressure from the wellbore 10 to act against the inner lips 872 of the sealing element 870.

Figure 9B:
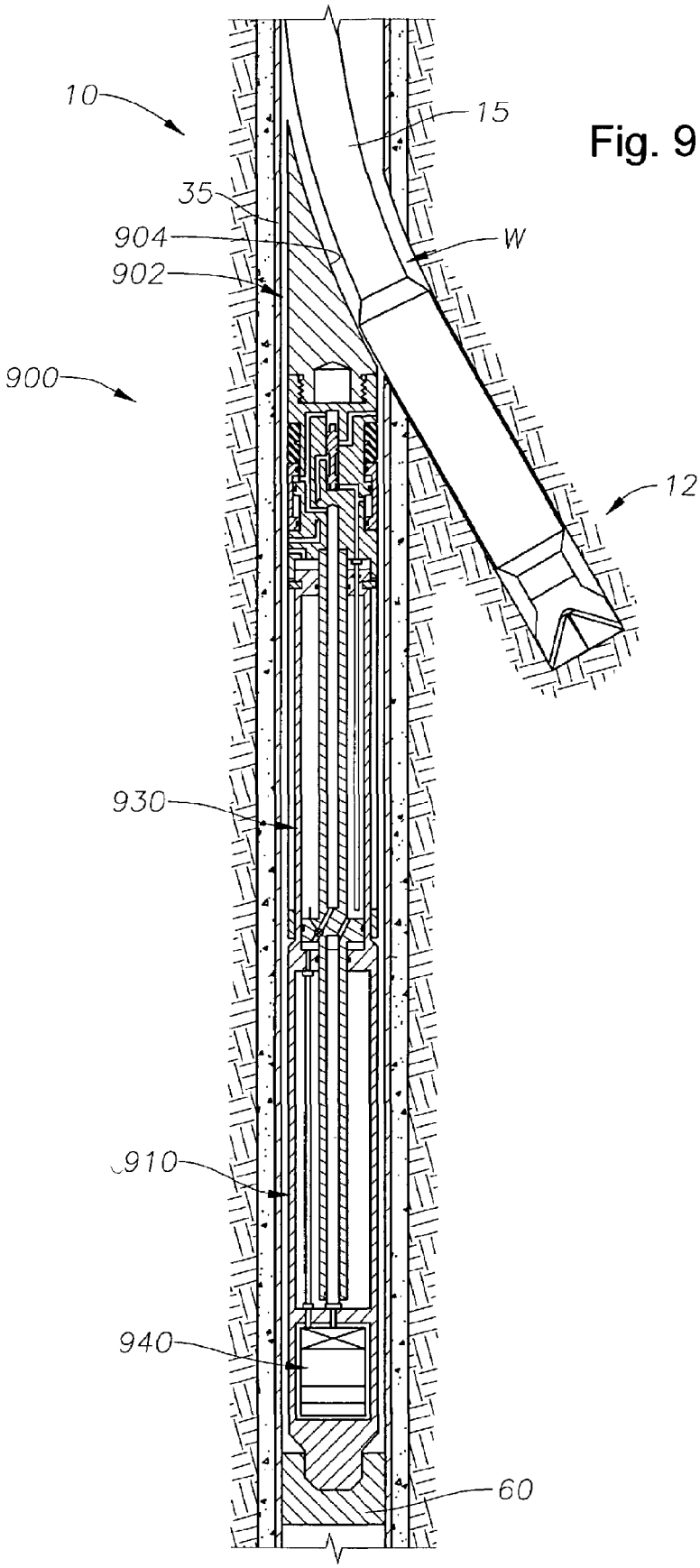
FIG. 9B presents a cross-sectional view of the wellbore isolation apparatus of FIG. 9A. The wellbore isolation apparatus has been run into a wellbore adjacent a lateral wellbore. Sidetrack drilling operations have already formed a window in the primary wellbore, and a lateral wellbore is being formed. In this view, the anchoring system for the whipstock has been actuated in order to set the whipstock in the surrounding casing.

FIG. 9A presents a final arrangement for a wellbore isolation apparatus 900. The apparatus 900 is again shown in cross-section. The wellbore isolation apparatus 900 is in its run-in position. This third arrangement is also integral to a whipstock 902. The whipstock 902 again includes a concave face 904 used to divert milling and drilling tools from a primary wellbore (shown at 10 in FIG. 9B) into a lateral wellbore (shown at 12 in FIG. 9B).

As with the wellbore isolation apparatuses 700, 800 of FIGS. 7A–E and FIGS. 8A–C, the wellbore isolation apparatus 900 of FIG. 9A first comprises an anchor body 910. The anchor body 910 has an upper end 912 and a lower end 914. The anchor body 910 serves as a base that is anchored into a primary wellbore 10 below a window W (shown in FIG. 9B) formed for a lateral wellbore 12. By anchoring the apparatus 900, an upper portion of the apparatus 900, including the whipstock 902, may again be urged upward within the primary wellbore 10. A sealing element 970 is then actuated above the lateral wellbore 12 to seal the primary wellbore 10.

FIG. 9B presents a cross-sectional view of the wellbore isolation apparatus 900 of FIG. 9A. The wellbore isolation apparatus 900 is disposed in a primary wellbore 10 adjacent a lateral wellbore 12. Sidetrack drilling operations have already formed a window W in the primary wellbore 10. A lateral wellbore 12 is seen being formed off of the primary wellbore 10. In the view of FIG. 9B, the body 910 has been anchored into the primary wellbore 10. A separate anchor 60, shown schematically in FIG. 9B, has been provided. In this arrangement, the bottom end 914 of the anchor body 910 defines an orienting base received within the anchor 60.

As noted, the anchor body 910 of the formation isolation apparatus 900 has a top end 912 and a bottom end 914. The top end 912 forms a shoulder having an upper surface 912U and a lower surface 912L. As will be described further below, the top end 912 slideably receives an elongated piston 920. An upper piston channel 918U is provided in the top end 912 of the anchor body 910 to guide the piston 920 as it travels through the upper piston channel 918U. The upper 912U and lower 912L surfaces radially encompass the upper piston channel 918U.

The anchor body 910 also includes an intermediate shoulder 913. As with the upper shoulder 912, the intermediate shoulder 913 has a top surface 913U and a lower surface 913L. The intermediate shoulder 913 includes a lower piston channel 918L that also slideably receives the piston 920. The upper 913U and lower 913L surfaces radially encompass the lower piston channel 918L.

A piston recess 916 is formed within the body 910 below the intermediate shoulder 913. As will be shown, the recess receives the lower end of a piston 920. The anchor body 910 also has a hollow bore therethrough that runs along the longitudinal axis of the body 910. The bore receives an outlet tube 944O.

Returning to FIG. 9A, the formation isolation apparatus 900 next comprises a sleeve 930. In one aspect, the sleeve 930 defines an elongated body having an upper portion 932 and a lower tubular portion 934. The upper portion 932 is connected to the lower concave portion 904 of the whipstock 902, while the lower tubular portion 934 receives the upper end 912 of the anchor body 910. The upper portion 932 of the sleeve 930 has a bore therein.

As noted, the formation isolation apparatus 900 also comprises a piston 920. The piston 920 in one arrangement defines an elongated tubular tool preferably fabricated from a metal alloy. The piston 920 has an upper end 922, a lower end 924, and an intermediate shoulder 926. The upper end 922 resides above the upper piston channel 918U of the anchor body 910, and is connected to the upper tubular portion 932 of the sleeve 930. An upper fluid channel 928U is formed in the upper end 922 of the piston 920. The upper fluid channel 928U is in fluid communication with the bore 938 of the sleeve 930. The lower end 924 of the piston 920 resides within the recess 916 of the body 910. The piston 920 is dimensioned to slideably move within the upper 918U and lower 918L piston channels.

As noted, the piston 920 includes an intermediate shoulder 926. The intermediate shoulder 926 is positioned between the upper 922 and lower 924 ends of the piston 920. The intermediate shoulder 926 has upper 926U and lower 926L surfaces. As noted, an upper fluid channel 928U is formed in the upper end 922 of the piston 920. Likewise, a lower fluid channel 928L is formed in the lower end 924 of the piston 920. The lower fluid channel 928L receives the shaft 919 of the body 910.

Residing within the intermediate shoulder 926 of the piston 920 is a pair of vents 921R, 921S. First, a releasing vent 921R is provided. The releasing vent 921R places the lower fluid channel 928L of the piston 920 in fluid communication with the piston recess 916 above the upper piston shoulder 926U. Second, a setting vent 921S is provided. The setting vent 921S places the upper fluid channel 928U in fluid communication with the recess 916 below the lower piston shoulder 926L. A contact probe 923 is provided on the upper surface 926U of the piston shoulder 926. As will be described below, when the contact probe 923 contacts the lower shoulder surface 912L of the upper end 912 of the body 910, the contact probe 923 permits fluid to travel from the piston recess 916 area above the piston shoulder 926L (outside of the upper fluid channel 928U) and to be released into the upper fluid channel 928U. A valve 925 is placed in the setting vent 921S that opens when the contact probe 923 contacts the lower shoulder surface 912L of the upper end 912 of the body 910.

The formation isolation apparatus 900 next comprises a sealing element 970. The sealing element 970 is circumferentially disposed about the upper portion 932 of the sleeve 930. Further, the sealing element 970 is disposed between an upper sleeve shoulder 931 and a tubular extrusion body 972. The sealing element 970 is actuated when it is compressed between the upper sleeve shoulder 931 and the extrusion body 972.

The extrusion body 972 sealingly encompasses the intermediate sleeve shoulder 937 of the sleeve 930. In this manner, an upper setting chamber 975 is formed above the shoulder 937, and a lower releasing chamber 977 is formed below the shoulder 937. A setting channel 974 is provided in the sleeve 930 . The setting channel 974 feeds fluid into the setting chamber 975 when it is desired to compress the sealing element 970. Likewise, a releasing channel 976 is also provided in the sleeve 930. The releasing channel 976 feeds fluid into the releasing chamber 977 when it is desired to release the sealing element 970. In this manner, the sealing element 870 is selectively extruded outward into sealed engagement with a surrounding casing string, such as liner 35.

The formation isolation apparatus 900 of FIG. 9A further comprises a sealing element actuation system 940. The sealing element actuation system 940 serves to urge the sleeve 930 and the piston 920 upward relative to the anchor body 910. Actuation of the apparatus 900 also causes the sealing element 970 to be extruded outward into sealed engagement with a surrounding casing string 35.

The sealing element actuation system 940 first comprises a pump 950. The pump 950 is disposed within a pump recess 951 in the anchor body 910. The pump 950 cycles fluid in and out of the piston recess 916. This means that the recess 916 is filled with fluid before run-in.

To aid in the circulation of fluid, a fluid inlet channel 942I is first connected to the pump 950. The fluid inlet channel 942I is connected to and is in fluid communication with a fluid inlet tube 944I. The fluid inlet tube 944I extends into the piston recess 916 below the lower shoulder surface 926L. In this manner, the pump 950 is in fluid communication with the recess 916 (below the lower shoulder surface 926L). The pump 950 includes a valve apparatus (shown schematically at 952). When fluid is drawn into the pump 950 from the recess 916, pressure is retained by the valve 952. Fluid is then delivered to a fluid outlet channel 942O, and then to a lower fluid channel 928L. In one aspect, a fluid outlet tube 944O is disposed within the lower fluid channel 928L of the piston 920.

The sealing element actuation system 940 also includes a power source 954. The power source 954 provides power for operating the pump 950. In the preferred arrangement, the power source 954 is a battery disposed within a recess of the anchor body 910. The power source 954 is in electrical communication with electronics. The electronics are shown schematically in FIG. 9A at 956. The electronics 956 are configured to receive communication from the surface in order to selectively actuate the pump 950. As with electronics 746 from FIG. 7A, in one aspect, the electronics 956 in FIG. 9A respond to acoustic signals delivered downhole, such as by a selected rotational sequence of the drill string (not shown).

As part of the actuation system 940, a releasing tube 944R is also provided. The releasing tube 944R is suspended within the piston recess 916 above the upper piston shoulder surface 926U. In this way, the bottom end of the releasing tube 944R is in fluid communication with the piston recess 916 above the upper piston shoulder surface 926U. The top end of the releasing tube 944R is connected to the upper portion 932 of the sleeve 930. Further, the top end of the releasing tube 944R is in fluid communication with the releasing vent 976. Thus, the releasing tube 944R serves to feed fluid to the releasing chamber 975 through the releasing vent 976.

In operation, the formation isolation apparatus 900 of FIG. 9A is run into the primary wellbore 10 on a working string. The process for setting the apparatus 900 and the integral whipstock 902 is as described above in connection with FIG. 7E, and need not be repeated. Further, an integral anchoring system 960 may be employed, as described for the formation isolation apparatus 700 of FIG. 7A . FIG. 9C presents a partial cross-sectional view showing the formation isolation apparatus 900 of FIG. 9A with an optional integral anchoring system 960. The anchoring system 960 is generally in accordance with the anchoring system 760 described above, and need not be described again. Parts 961, 962, 963, 964, 966, 967 and 968 from FIG. 9A correspond to parts 761, 762, 763, 764, 676, 767, and 768 from FIG. 7A. However, it is noted that the setting chamber 968 is fed by pressure from the pump 950, rather than from wellbore pressure and a rupture disc.

Figure 9D:
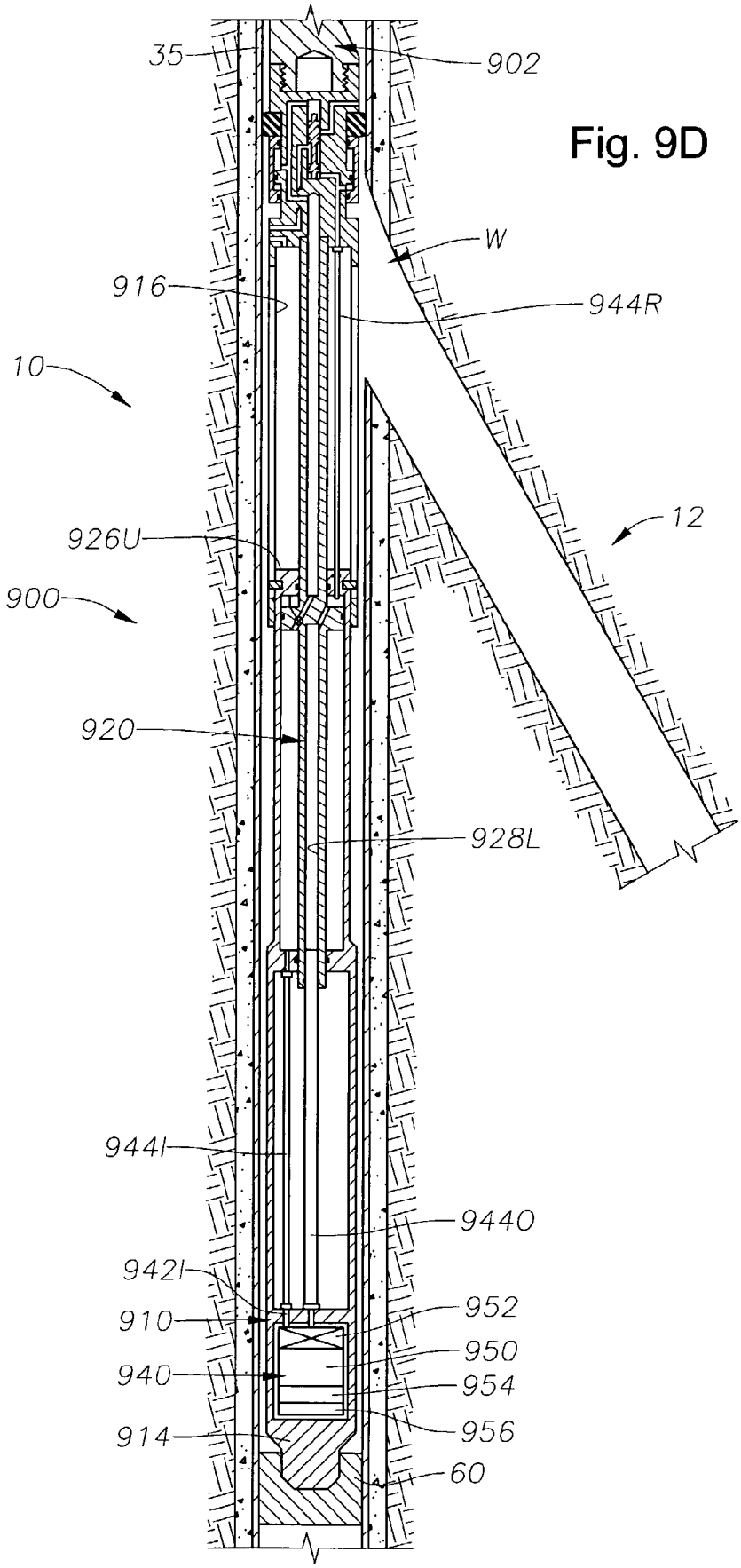
FIG. 9D presents a cross-sectional view of the wellbore isolation apparatus of FIG. 9B. Here, the wellbore isolation apparatus has been actuated so as to raise the sealing element above the depth of the lateral wellbore, and to set the sealing element in the surrounding casing.

FIG. 9D presents a cross-sectional view of the wellbore isolation apparatus 900 within the wellbore 10 of FIG. 9B. Here, the wellbore isolation apparatus 900 has again been anchored within the primary wellbore 10. In addition, the sealing element actuation system 940 has been actuated so as to raise the sealing element 970 above the depth of the lateral wellbore 12. To accomplish this, the electronics receive a signal to turn on the pump 950. The pump 950 begins to pump fluid from the piston recess 916 (from above the upper surface 926U of the piston shoulder 926), through the releasing vent 921R, through the fluid outlet tube 944O, and through the fluid outlet channel 942O. From there, fluid is delivered through the valve apparatus 952 and into the fluid inlet channel 942I and the fluid inlet tube 944I. Fluid is then further delivered under pressure into the recess 916 below the lower shoulder surface 926L.

As pressure builds in the recess 916 below the lower shoulder surface 926L, the piston 920 is urged upward. This means that the piston 920 is traveling upward through the piston recess 916. Because the upper end 922 of the piston is connected to the upper end 932 of the sleeve 930, upward movement of the piston 920 causes the sleeve 930 to be raised relative to the anchor body 910. The concave face portion 904 of the whipstock 902 is also moved upward . As the piston 920 approaches the top end of its stroke, the contact probe 923 contacts the lower shoulder surface 912L of the upper end 912 of the body 910. The contact probe 923 opens the valve 925, thereby permitting fluid to travel from the piston recess 916 area below the piston shoulder 926L, through the setting vent 921S, and from there to be released into the upper fluid channel 928U. Fluid continues to travel upward through the upper fluid channel where it enters the bore 938 of the sleeve 930. From there, fluid under pressure travels through the setting channel 974 and enters the setting chamber 975. This, in turn, drives the extrusion body 972 against the sealing element 970. The sealing element 970 is thereby compressed between the upper sleeve shoulder 931 and the extrusion body 972 so as to be extruded outward. Ultimately, and as shown in FIG. 8D, the sealing element 870 is extruded into sealing engagement with the surrounding casing 35 at a depth above the lateral wellbore 12. The formation pressures within the lateral wellbore 12 are thereby isolated.

At some point, the operator will want to come back into the wellbore 10 with new operating equipment. In order to access the lateral wellbore 12 for further drilling or completion operations, the formation isolation apparatus 900 will need to be unsealed and deactuated. In the present arrangement, the operator sends a new signal to the electronics 956, instructing the pump 950 to reverse flow, thereby pumping fluid from the upper fluid channel 928U, through the setting vent 921S, and into the piston recess area 996 below the lower shoulder 926L. From there, fluid flows into the fluid inlet tube 944I, through the fluid inlet channel 942I, back through the valve apparatus 952, through the fluid outlet channel 942O, and into the fluid outlet channel 944O. This causes fluids to be pumped from the portion of the piston recess 916 below the piston shoulder 926L, and into the portion of the piston recess 916 above the piston shoulder 926U. The piston 920 and connected sleeve 930 and whipstock 902 are thereby urged back downward relative to the anchor body 910.

It should also be noted that pumping fluid through the releasing vent 921R and into the piston recess area 916 above the shoulder 926U causes fluid to enter the releasing tube 944R. From there, fluid under pressure travels through the releasing channel 976 and enters the releasing chamber 977. This, in turn, drives the extrusion body 972 away from the sealing element 970, allowing the sealing element 970 to be released.

An optional unloader apparatus 990 is shown in FIGS. 9A and 9C. The purpose of the unloader 990 is to provide pressure equalization above and below the sealing element 970 when it is desired to release the sealing element 970. The unloader 990 first comprises a piston 992. The piston 992 includes an intermediate portion having a reduced outer diameter. The piston 992 is movable within an unloader recess 991. Upper 996 and lower 995 vents are provided off of the recess 991. The upper 996 vent provides fluid communication with the wellbore 10 above the sealing element 970, while the lower 995 vent provides fluid communication with the wellbore 10 below the sealing element 970. When the formation isolation apparatus 900 is being actuated, fluid pressure feeds from the setting channel 974 to the top of the piston recess 991. This drives the piston 992 downward within the recess, sealing off any communication between the upper 996 and lower 995 vents. However, when the formation isolation apparatus 900 is being unset, fluid pressure feeds from the releasing channel 975 to the bottom of the piston recess 991. This drives the piston 992 upward within the recess, allowing fluid to pass through the reduced diameter portion of the piston 992, and allowing fluid communication to take place between the upper 996 and lower 995 vents. As the vents 996, 995 are placed in fluid communication, pressure above and below the sealing element 970 is equalized. It is noted that a seal 993 is also placed along the recess 991 to prevent fluid from traveling directly from the releasing channel 976 through the lower vent 995.

While the foregoing is directed to embodiments of the present invention, other and further embodiments of the invention may be devised without departing from the basic scope thereof, and the scope thereof is determined by the claims that follow. In this respect, it is within the scope of the present invention to use the formation isolation apparatuses disclosed herein in connection with any wellbore operation, and is not limited to underbalanced drilling procedures.

The invention claimed is:

1. An apparatus for maintaining a wellbore condition during a wellbore operation, the apparatus comprising:

a selectively actuatable wellbore isolation member having a valve being moveable between an open position and a closed position, and being biased to its closed position, wherein the selectively actuatable wellbore isolation member is a plug that comprises:

a tubular plug body, wherein the valve is disposed along an inner surface of the tubular plug body;

a sealing element disposed around the plug body; and an anchoring member;

a wellbore operation tool coupled to the wellbore isolation member; and a tubular string releasably connected to the wellbore isolation member, wherein the tubular string is releasable from the isolation member while at least a portion of the isolation member maintains the wellbore condition, wherein the wellbore isolation member further comprises a setting/releasing tool for selectively actuating the plug, the setting/releasing tool comprising:

a tubular inner mandrel having a top end and a bottom end;

a setting system for urging the sealing element and the anchoring member outward into engagement with the surrounding wellbore when the setting system is actuated;

a releasing system for urging the sealing element and the anchoring member inward towards the plug body when the releasing system is actuated;

a releasable connector for releasably connecting the setting releasing tool from the tubular plug body; and wherein the bottom end of the tubular inner mandrel of the setting/releasing tool holds a flapper valve in its open position when the setting/releasing tool is connected to the plug, but clears the flapper valve to close when the setting/releasing tool is released from the plug and raised within the wellbore.

2. The apparatus for maintaining a wellbore condition of claim 1, wherein:

the tubular string is a string of drill pipe;

the setting/releasing tool is rotationally locked with the drill pipe; and the wellbore operation tool is disposed below the wellbore isolation member.

3. The apparatus for maintaining a wellbore condition of claim 2, wherein the drill pipe is connected to the setting/releasing tool at the top end of the setting/releasing tool.

4. The apparatus for maintaining a wellbore condition of claim 1, wherein the setting system further comprises:

a setting system motor;

a mechanically driven setting piston housed within a first piston recess within the inner mandrel;

an electrical setting line for electrically connecting the setting system motor to the mechanically driven piston;

a hydraulically driven setting piston housed within a second piston recess within the inner mandrel, the second piston recess having a fluid reservoir therein;

a hydraulic setting line for receiving fluid from the fluid reservoir when the setting system is actuated; and a setting chamber for receiving fluid from the hydraulic setting line, the setting chamber being disposed along the inner mandrel of the setting/releasing tool.

5. The apparatus for maintaining a wellbore condition of claim 4, wherein the releasing system further comprises:

a releasing system motor;

a mechanically driven releasing piston housed within a third piston recess within the inner mandrel;

an electrical releasing line for electrically connecting the releasing system motor to the mechanically driven releasing piston;

a hydraulically driven releasing piston housed within a second piston recess within the inner mandrel, the second piston recess having a fluid reservoir therein;

a hydraulic setting line for receiving fluid from the fluid reservoir when the releasing system is actuated; and a setting chamber for receiving fluid from the hydraulic releasing line, the releasing chamber also being disposed along the inner mandrel of the setting/releasing tool.

6. A wellbore isolation apparatus for use during a drilling operation, the wellbore isolation apparatus being connected to a working string within the wellbore, and the wellbore isolation apparatus comprising:

a tubular plug, the plug comprising:

a tubular plug body, a sealing element disposed around the plug body, an anchoring member; and a flapper valve disposed along an inner surface of the tubular plug body, the flapper valve being moveable between an open position and a closed position, and being biased to its closed position;

a setting/releasing tool connected to the working string, the setting/releasing tool comprising:

a tubular inner mandrel having a top end and a bottom end, a setting system for urging the sealing element and the anchoring member outward into engagement with the surrounding wellbore when the setting system is actuated, and a releasing system for urging the sealing element and the anchoring member inward towards the plug body when the releasing system is actuated;

a releasable connector for releasably connecting the setting/releasing tool from the tubular plug;

and wherein the bottom end of the tubular inner mandrel of the setting/releasing tool holds the flapper valve in its open position when the setting/releasing tool is connected to the plug, but clears the flapper valve to close when the setting/releasing tool is released from the plug and raised within the wellbore.

7. The well bore isolation apparatus of claim 6, wherein:

the working string is a drill string; and the setting/releasing tool is rotationally locked with the drill string.

8. The wellbore isolation apparatus of claim 7, wherein the drill string is connected to the setting/releasing tool at the top end of the setting/releasing tool.

9. The wellbore isolation apparatus of claim 7, wherein:

the plug further comprises an inner profile proximate to the top end of the plug; and the releasable connector between the setting/releasing tool and the plug comprises a first collet having fingers that releasably connect to the inner profile of the plug.

10. The wellbore isolation apparatus of claim 6, wherein the setting system further comprises:

a setting system motor;

a mechanically driven setting piston housed within a first piston recess within the inner mandrel;

an electrical setting line for electrically connecting the setting system motor to the mechanically driven piston;

a hydraulically driven setting piston housed within a second piston recess within the inner mandrel, the second piston recess having a fluid reservoir therein;

a hydraulic setting line for receiving fluid from the fluid reservoir when the setting system is actuated; and a setting chamber for receiving fluid from the hydraulic setting line, the setting chamber being disposed along the inner mandrel of the setting/releasing tool.

11. The wellbore isolation apparatus of claim 10, wherein the releasing system further comprises:

a releasing system motor;

a mechanically driven releasing piston housed within a third piston recess within the inner mandrel;

an electrical releasing line for electrically connecting the releasing system motor to the mechanically driven releasing piston;

a hydraulically driven releasing piston housed within a second piston recess within the inner mandrel, the second piston recess having a fluid reservoir therein;

a hydraulic setting line for receiving fluid from the fluid reservoir when the releasing system is actuated; and a setting chamber for receiving fluid from the hydraulic releasing line, the releasing chamber also being disposed along the inner mandrel of the setting/releasing tool.

12. The wellbore isolation apparatus of claim 11, wherein:

the setting system motor and the releasing system motor are each powered by a downhole power system; and the hydraulically driven selling piston and the hydraulically driven releasing piston are each powered by injecting fluid under pressure into the wellbore.

13. The wellbore isolation apparatus of claim 12, wherein the downhole power system comprises:

a battery in electrical communication with the setting system motor and with the releasing system motor; and a signal processor for receiving signals through the wellbore so as to selectively actuate the setting system and the releasing system.

14. The wellbore isolation apparatus of claim 6, wherein the plug is multi-set.

15. The wellbore isolation apparatus of claim 6, wherein the tubular plug further comprises:

a tubular upper setting sleeve disposed about a portion of the plug body, the upper setting sleeve having a top end that extends above the top end of the plug body, and a bottom end;

a tubular lower setting sleeve, the lower setting sleeve having an upper end disposed about the lower end of the upper setting sleeve, and a lower end disposed about a portion of the plug body; and a tubular upper cone member disposed about the plug body below the lower setting sleeve.

16. The wellbore isolation apparatus of claim 15, wherein:

the sealing element is radially disposed about a portion of the lower setting sleeve;

the anchoring member is radially disposed about a portion of the plug body; and the upper cone member is disposed between the sealing element and the anchoring member.

17. The wellbore isolation apparatus of claim 16, wherein:

the plug body further comprises an inner profile proximate to the top end of the plug body;

the upper setting sleeve further comprises an inner profile proximate to the top end of the upper setting sleeve; and the releasable connector between the setting/releasing tool and the plug comprises a first collet having fingers that releasably connect to the inner profile of the plug body, and a second collet having fingers that releasably connect to the inner profile of the upper setting sleeve.

18. The wellbore isolation apparatus of claim 17, further comprising:

an upper gauge ring having a top end connected to the bottom end of the lower setting sleeve, and a lower end connected to a top surface of the sealing element; and a lower gauge ring having a top end connected to a bottom surface of the sealing element, and a lower end connected to the cone member.

19. The wellbore isolation apparatus of claim 18, wherein:

the working string is a drill string; and the setting/releasing tool is rotationally locked with the drill string.

20. The wellbore isolation apparatus of claim 19, wherein the drill string is connected to the setting/releasing tool at the top end of the setting/releasing tool.

21. The wellbore isolation apparatus of claim 19, further comprising:

teeth disposed radially around a portion of the plug body; and a snap ring defining a C-ring having a gap disposed around the teeth, the snap ring ratcheting along the teeth as the setting system is actuated so as to hold the upper setting sleeve in place.

22. The wellbore isolation apparatus of claim 21, further comprising a trapezoidal lug received within the gap of the snap ring, the lug being connected to the bottom end of the upper setting sleeve, the lug releasing the snap ring from the teeth when the releasing system is actuated.

23. A method for isolating formation pressure in a wellbore during a wellbore operation, the wellbore having a string of pipe therein, the pipe having a plug and a wellbore operation tool attached to the lower end of the pipe, the method comprising the steps of:

setting the plug a first time so as to isolate formation pressures in the wellbore below the plug;

releasing the string of pipe from the plug;

removing the released string of pipe from the wellbore;

releasing the set plug a first time from the wellbore;

removing the plug and wellbore operation tool with a wireline;

manipulating the wellbore operation tool at the surface;

re-running the plug and wellbore operation tool into the wellbore on the wireline;

setting the plug a second time so as to again isolate formation pressures in the wellbore below the plug; and releasing the set plug a second time so as to allow pressure communication through the plug.

24. The method for isolating formation pressure of claim 23, wherein:

the wellbore operation tool is a drill bit; and the wellbore operation is a formation drilling operation.

25. The method for isolating formation pressure of claim 24, the method further comprising the steps of:

removing a portion of the string of pipe from the wellbore before setting the plug the first time; and discontinuing the removal of drill pipe from the wellbore before a condition of pipe light is reached.

26. The method for isolating formation pressure of claim 23, wherein the plug comprises:

a tubular plug body, a sealing element disposed around the plug body, and an anchoring member.

27. The method for isolating formation pressure of claim 26, wherein the plug further comprises:

a flapper valve disposed along an inner surface of the tubular plug body, the flapper valve being moveable between an open position and a closed position, and being biased to its closed position.

28. The method for isolating formation pressure of claim 27, wherein the plug is part of a formation isolation apparatus further comprising:

a setting/releasing tool connected to the string of pipe, the setting/releasing tool comprising:

a tubular inner mandrel rotationally locked with the string of pipe, the inner mandrel having a top end and a bottom end;

a setting system for urging the sealing element and the anchoring member outward into engagement with the surrounding wellbore when the setting system is actuated;

a releasing system for urging the sealing element and the anchoring member inward towards the plug body when the releasing system is actuated; and a releasable connector for releasably connecting the setting/releasing tool from the tubular plug body;

and wherein the bottom end of the tubular inner mandrel of the setting/releasing tool holds the flapper valve in its open position when the setting/releasing tool is connected to the plug body, but clears the flapper valve to close when the setting/releasing tool is released from the plug body and raised within the wellbore.

29. The method for isolating formation pressure of claim 28, wherein the formation isolation apparatus further comprises:

a selling system motor;

a mechanically driven setting piston housed within a first piston recess within the inner mandrel;

an electrical setting line for electrically connecting the setting system motor to the mechanically driven piston;

a hydraulically driven setting piston housed within a second piston recess within the inner mandrel, the second piston recess having a fluid reservoir therein;

a hydraulic setting line for receiving fluid from the fluid reservoir when the setting system is actuated; and a setting chamber for receiving fluid from the hydraulic setting line, the setting chamber being disposed along the inner mandrel of the setting/releasing tool.

30. The method for isolating formation pressure of claim 29, wherein the releasing system further comprises:

a releasing system motor;

a mechanically driven releasing piston housed within a third piston recess within the inner mandrel;

an electrical releasing line for electrically connecting the releasing system motor to the mechanically driven releasing piston;

a hydraulically driven releasing piston housed within a second piston recess within the inner mandrel, the second piston recess having a fluid reservoir therein;

a hydraulic setting line for receiving fluid from the fluid reservoir when the releasing system is actuated; and a setting chamber for receiving fluid from the hydraulic releasing line, the releasing chamber also being disposed along the inner mandrel of the setting/releasing tool.

31. The method for isolating formation pressure of claim 30, wherein:

the setting system motor and the releasing system motor are each powered by a downhole power system; and the hydraulically driven setting piston and the hydraulically driven releasing piston are each powered by injecting fluid under pressure into the wellbore.

32. The method for isolating formation pressure of claim 31, wherein the downhole power system comprises:

a battery in electrical communication with the setting system motor and with the releasing system motor; and a signal processor for receiving signals through the wellbore so as to selectively actuate the setting system and the releasing system.

33. The method for isolating formation pressure of claim 32, wherein:

the plug further comprises an inner profile proximate to the top end of the plug; and the releasable connector between the setting/releasing tool and the plug comprises a first collet having fingers that releasably connect to the inner profile of the plug.

34. The method for isolating formation pressure of claim 26, wherein the plug is multi-set.

35. A method for isolating a condition in a wellbore during a wellbore operation, comprising:

coupling a wellbore operation tool to a selectively actuatable wellbore isolation member, wherein the selectively actuatable wellbore isolation member comprises;

a tubular plug body;

a sealing element disposed around the plug body;

an anchoring member; and a setting/releasing tool comprising:

a tubular inner mandrel having a top end and a bottom end;

a setting system for urging the sealing element and the anchoring member outward into engagement with the surrounding wellbore when the setting system is actuated;

a releasing system for urging the sealing element and the anchoring member inward towards the plug body when the releasing system is actuated;

a releasable connector for releasably connecting the setting/releasing tool from the tubular plug body; and wherein the bottom end of the tubular inner mandrel of the setting/releasing tool holds a flapper valve in its open position when the setting/releasing tool is connected to the tubular plug body, but clears the flapper valve to close when the setting/releasing tool is released from the plug and raised within the wellbore;

running the wellbore operation tool and coupled wellbore isolation member into the wellbore on a pipe string;

conducting at least a part of the wellbore operation;

setting the wellbore isolation member in the wellbore a first time in order to isolate a condition in the wellbore below the wellbore isolation member;

releasing at least a portion of the remaining pipe string from the wellbore isolation member;

retrieving the wellbore operation tool and coupled wellbore isolation member from the wellbore;

manipulating the wellbore operation tool;

re-running the wellbore operation tool and coupled wellbore isolation member into the wellbore; and setting the wellbore isolation member in the wellbore a second time in order to again isolate a condition in the wellbore below the wellbore isolation member.

36. The method for isolating a condition in a wellbore of claim 35, wherein:

the tubular string is a string of drill pipe;

the setting/releasing tool is rotationally locked with the drill pipe; and the wellbore operation tool is disposed below the wellbore isolation member.

37. The method for isolating a condition in a wellbore of claim 36, wherein the drill pipe is connected to the setting/releasing tool at the top end of the setting/releasing tool.

38. The method for isolating a condition in a wellbore of claim 35, wherein the selling system further comprises:

a setting system motor;

a mechanically driven setting piston housed within a first piston recess within the inner mandrel;

an electrical setting line for electrically connecting the setting system motor to the mechanically driven piston;

a hydraulically driven setting piston housed within a second piston recess within the inner mandrel, the second piston recess having a fluid reservoir therein;

a hydraulic setting line for receiving fluid from the fluid reservoir when the setting system is actuated; and a selling chamber for receiving fluid from the hydraulic setting line, the setting chamber being disposed along the inner mandrel of the setting/releasing tool.

39. The method for isolating a condition in a wellbore of claim 38, wherein the releasing system further comprises:

a releasing system motor;

a mechanically driven releasing piston housed within a third piston recess within the inner mandrel;

an electrical releasing line for electrically connecting the releasing system motor to the mechanically driven releasing piston;

a hydraulically driven releasing piston housed within a second piston recess within the inner mandrel, the second piston recess having a fluid reservoir therein;

a hydraulic setting line for receiving fluid from the fluid reservoir when the releasing system is actuated; and a setting chamber for receiving fluid from the hydraulic releasing line, the releasing chamber also being disposed along the inner mandrel of the setting/releasing tool.

* * * * *

UNITED STATES PATENT AND TRADEMARK OFFICE

CERTIFICATE OF CORRECTION

PATENT NO. : 7,086,481 B2
APPLICATION NO. : 10/270015
DATED : August 8, 2006
INVENTOR(S) : David Hosie and Mike A. Luke It is certified that error appears in the above-identified patent and that said Letters Patent is hereby corrected as shown below:

<u>In the Claims section</u>:

In column 37, Claim 29, line 67, please delete “selling” and insert --setting--.

In column 40, Claim 38, line 14, please delete “selling” and insert --setting--.

Signed and Sealed this

Thirteenth Day of March, 2007

JON W. DUDAS
*Director of the United States Patent and Trademark Office*